United States Patent [19]

Krekeler

[11] 4,275,929

[45] Jun. 30, 1981

[54] MEANS FOR REMOVABLY AFFIXING A CUTTER BIT MOUNTING LUG TO A BASE MEMBER ON THE DRIVEN ELEMENT OF A MINING MACHINE OR THE LIKE

[75] Inventor: Claude B. Krekeler, Cincinnati, Ohio

[73] Assignee: The Cincinnati Mine Machinery Company, Cincinnati, Ohio

[21] Appl. No.: 936,840

[22] Filed: Aug. 25, 1978

[51] Int. Cl.[3] ..... E21C 25/12

[52] U.S. Cl. ..... 299/91; 299/86

[58] Field of Search ..... 299/79, 91–93, 299/86

[56] References Cited

U.S. PATENT DOCUMENTS

| | | | |
|---|---|---|---|
| 1,962,426 | 3/1933 | Radius | 299/93 |
| 2,131,188 | 9/1938 | Osgood | 299/93 |
| 2,190,000 | 2/1940 | Stenger et al. | 299/93 |
| 3,093,365 | 6/1963 | Krekeler | 299/92 |
| 3,608,218 | 9/1971 | Sturgeon | 299/92 |
| 3,749,449 | 7/1973 | Krekeler | 299/93 |

*Primary Examiner*—William F. Pate, III

*Attorney, Agent, or Firm*—Frost & Jacobs

[57] ABSTRACT

A cutter bit mounting lug, a base member for mounting the lug to the driven element of a mining machine or the like and retaining means to prevent undesired disengagement of the lug from its base member. The lug and base member are so configured as to have a wedging engagement therebetween. The retaining means is separate from the lug and is so positioned with respect thereto as to be installable after the mounting of the lug on its base member and so as to be free of the resultant cutting forces sustained by the lug and the base member.

33 Claims, 52 Drawing Figures

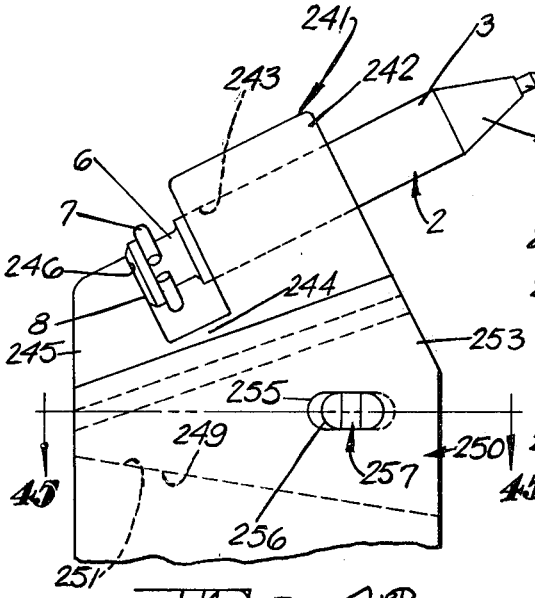
FIG. 4A2
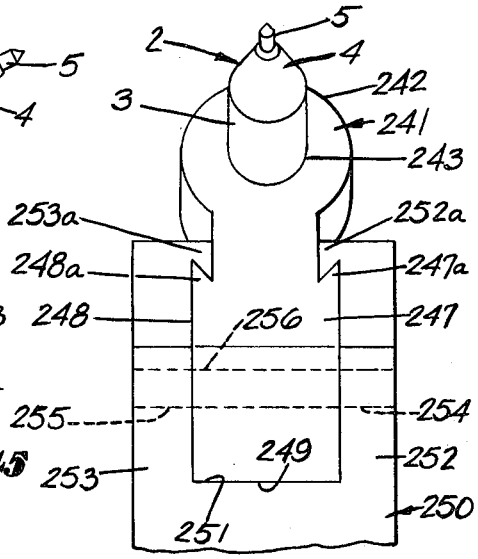
FIG. 4A3
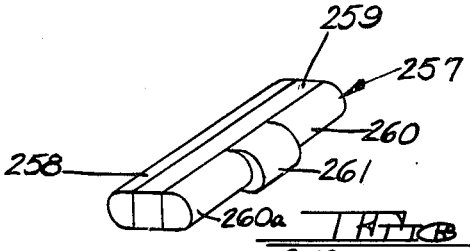
FIG. 4A4
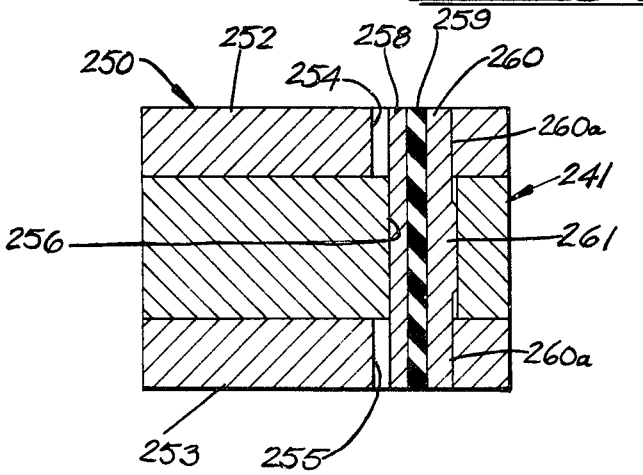
FIG. 4A5

MEANS FOR REMOVABLY AFFIXING A CUTTER BIT MOUNTING LUG TO A BASE MEMBER ON THE DRIVEN ELEMENT OF A MINING MACHINE OR THE LIKE

TECHNICAL FIELD

The invention relates to cutter bit lugs and the base members by which the lugs are affixed to the driven elements of mining machines or the like; and more particularly to cutter bit lugs and base members having a wedging interengagement and being provided with retaining means for the lugs, such that the lugs can be easily and quickly installed or removed and replaced, but undesired disengagement of the lugs from their base members will be prevented.

BACKGROUND ART

For purposes of exemplary showings, the teachings of the present invention will be described in their application to cutter bit carrying lugs and base members mounted on the driven element of a mining machine. It will be immediately apparent, however, to one skilled in the art that the teachings of the present invention may be readily applied to work tool carrying lugs and base members mounted on the driven elements of other types of earthworking and digging machines. Such applications of the teachings of the present invention to earthworking and digging machines can readily be accomplished by one skilled in the art without the exercise of invention. Therefore, such terms as "cutter bit", "mining machine", and "cutting direction" are intended to be broadly interpreted to include digger teeth and the like, earthworking and digging machines and digging direction, respectively.

There are many types of well known mining machines. They all have one thing in common in that they are provided with some form of driven element adapted to support one or more, and usually a plurality of, cutter bit-lug assemblies and to drive such assemblies in a cutting direction against the material being mined. As indicated above, the driven elements of mining machines may take many forms. A non-limiting list of such driven elements includes cutter chains, cutter bars, cutter arms, cutter wheels, cutter drums, oscillating rippers, longwall cutters and the like.

In normal mining operations, cutter bits require frequent replacement due to wear or breakage. It is not unusual for cutter bits to be replaced on a daily basis. The cutter bits are mounted in lugs and the prior art has done much work on the provision of cutter bits which are readily replaceable with respect to their mounting lugs, having developed, among other things, a variety of cutter bits having a "knock-in, pry-out" mounting relationship with respect to their lugs and bits having readily removably retaining means maintaining them in their respective lugs.

The lug means in which the cutter bits are held, on the other hand, are characterized by a longer service life. As a result, the most common practice heretofore has been to permanently affix the lugs to the driven elements of the mining machines as by welding or the like. Nevertheless, the lugs themselves are subject to wear and breakage. Under extremely severe conditions, lugs may require replacement on a weekly basis.

Since the lugs have usually been welded or otherwise permanently affixed to the driven element of the mining machine, their replacement has been difficult. Where possible, their replacement has been attempted in the field. Frequently, however, it has been necessary to remove the driven element from the mining machine and to take it to a place where repairs can be made. In either event, lug replacement has been a difficult and time consuming procedure resulting in considerable down time for the mining machine.

As a consequence, it is not unusual that replacement of one or more broken lugs was postponed until the operator of the mining machine simply had no other alternative. However, when broken or worn lugs are not replaced, the efficiency of the mining machine is diminished and an undue strain is placed upon adjacent bits and lugs. One or more broken lugs can also result in the production of float dust which not only renders the mining operation more difficult, but also constitutes a hazard to the health.

Only recently have prior art workers expended effort in overcoming the problem of providing a readily replaceable cutter bit lug. Exemplary recent prior art approaches are set forth in United States Letters Pat. No. Re. 28,310 and United States Letters Pat. No. 4,057,294. The first of the above mentioned U.S. Patents is directed primarily to a lug and base member assembly wherein the lug is affixed to the base member by a removable pin which passes transversely through portions of the base member and the lug. The base member and lug are so configured as to reduce the resultant cutting forces sustained by the pin.

The last mentioned United States Patent teaches a different approach wherein the cutter bit lug and the base member have a wedging relationship and the retaining means for the lug takes the form of a wedging device adapted to implement the wedging relationship between the lug and base member so as to prevent undesired disengagement of the lug from the base member. Again, all of the retaining means taught in this reference are subject to the resultant cutting forces during the mining operation.

The present invention is directed to a base member which may be permanently affixed to the driven element of a mining machine and to a cutter bit carrying lug which is removably mounted on the base member. A retaining means is also provided to assure against undesired disengagement of the lug from the base member. The lug and base member have a wedging interengagement. In all of the embodiments, the retaining means does not constitute an integral part of the lug and can be installed after the lug is mounted on the base member. In all but two of the embodiments of the present invention the retainer is free of resultant cutting forces. In all but three of the embodiments, the retaining means is located exteriorally of the lug. Finally, in only one of the embodiments of the present invention does the retaining means extend transversely through portions of both the base member and the lug.

DISCLOSURE OF THE INVENTION

In accordance with the invention there is provided in a mining machine or the like of the type having at least one driven element adapted to advance a plurality of cutter bit-lug assemblies in a cutting direction, each cutter bit being mounted in a lug with a cutting end of the cutter bit exposed to act upon the material being cut and a plurality of base members mounted on the driven element and to which the cutter bit carrying lugs are removably mounted, the improvement comprising each of the lugs and base members being configured so as to have a wedging engagement therebetween and retaining means to prevent undesired disengagement of the lug from its base member, the retaining means being separate from the lug and so positioned with respect thereto as to be installable after the mounting of the lug on the base member and as to be free of the resultant cutting forces sustained by the lug and the base member.

BRIEF DESCRIPTION OF THE DRAWINGS

FIG. 33 is a perspective view of the lug of FIGS. 30 and 31 and a base member similar to that of FIG. 2, but provided with a retaining means for the lug.

FIG. 34 is a fragmentary cross sectional elevational view of the lug of FIG. 30 mounted on the base member of FIG. 32 and provided with a bolt-like retainer.

FIG. 35 is a fragmentary cross sectional elevational view similar to that of FIG. 34 and again illustrating the lug of FIG. 30 mounted on the base member of FIG. 32, but provided with a different type of bolt-like retainer.

FIG. 42 is a fragmentary elevational view of another embodiment of lug, base member and retaining means of the present invention.

FIG. 43 is a fragmentary front elevational view of the structure of FIG. 42.

FIG. 44 is a perspective view of the retaining means of FIGS. 42 and 43.

FIG. 45 is a cross sectional view taken along section line 45—45 of FIG. 42.

FIG. 46 is a fragmentary elevational view of another embodiment of lug, base member and retaining means of the present invention.

FIG. 47 is a fragmentary elevational view of yet another lug, base member and retaining means of the present invention.

FIG. 48 is a fragmentary perspective view illustrating a modification of the base member of FIG. 47.

DETAILED DESCRIPTION OF THE INVENTION

Figure 1:
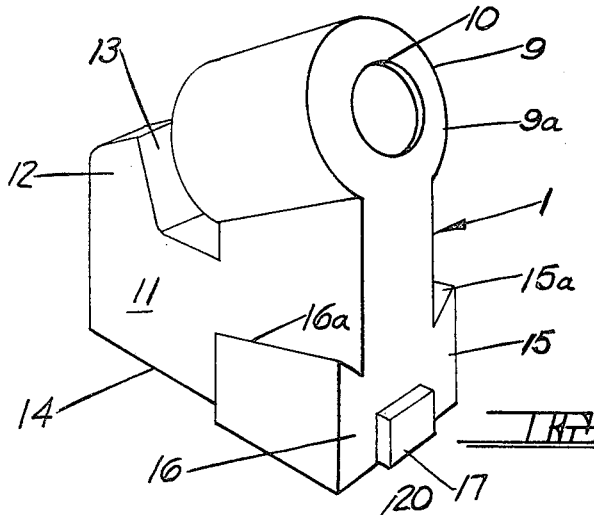
FIG. 1 is a perspective view of a lug of the present invention.

It is to be understood from the outset that in the lug-base member-retaining means assemblies of the present invention, the nature of the cutter bit or other work tool to be mounted in the lug does not constitute a limitation on the present invention. The configuration of that portion of the lug which cooperates with the base member and the retaining means does constitute a part of the present invention. The remainder of the lug (i.e. that portion, the configuration of which is dictated by the cutter bit or work tool to be supported therein), however, may be varied in all of the embodiments to be described hereinafter. In order to provide a complete showing, each of the embodiments described illustrates a complete lug adapted for a specific cutter bit. This is not intended to so limit that embodiment, as is shown by the fact that various types of lugs for various types of cutter bits are shown throughout the embodiments illustrated.

Reference is first made to FIGS. 1 through 4, wherein like parts have been given like index numerals. An exemplary cutter bit lug is generally indicated at 1 in FIG. 1. The lug, for purposes of an exemplary illustration is shown as being of the type taught in U.S. Pat. Nos. 3,397,012 and 3,397,013. Such a lug is adapted to receive and support a rotatable pick-type bit. An exemplary bit is generally indicated at 2 in FIG. 4.

Briefly, the cutter bit 2 comprises an elongated shank 3 of circular cross section having at one end a conical nose 4 terminating in a hard cutting tip 5. At the other end of the shank there is an annular notch 6 adapted to receive a bit retaining means such as the removable split metal ring 7. This same end of the cutter bit terminates in an abutment surface 8 adapted to cooperate with an abutment surface on the lug, as will be evident.

The lug 1 of FIGS. 1 and 4 has a main body portion 9 with a forward surface 9*a* and a rearward surface 9*b* (see FIG. 4). A shank receiving perforation 10 extends through the body 9 and forms openings in the forward and rearward surfaces. The lug 1 has a rearward extension 11 terminating in an anvil portion 12 having an abutment surface 13. The abutment surface 13 is adapted to cooperate with the abutment surface 8 of cutter bit 2 so as to determine the gauge or depth to which the cutter bit extends into shank receiving perforation 10. As is evident from FIG. 4, the split metal ring retainer 7 has an external diameter slightly greater than the diameter of shank receiving perforation 10, so as to prevent removal of cutter bit 2 therefrom until such time as the split metal ring retainer 7 is removed from the cutter bit.

The bottom surface 14 of lug 1 is essentially flat. The lug has a pair of lateral extensions 15 and 16 which are mirror image equivalents of each other. The sides of extensions 15 and 16 are essentially vertical and their bottom surfaces are coextensive with the lug bottom 14. The extensions 15 and 16 are of a length less than the front to rear length of the lug. The upper surfaces 15*a* and 16*a* of extensions 15 and 16 are dovetailed and at the same time slope slightly downwardly and rearwardly from the front of the lug. The lug may also be provided with a small, substantially rectangular extension 17 on its forward face and near the bottom thereof. The purpose of extension 17 will be apparent hereinafter.

Figure 2:
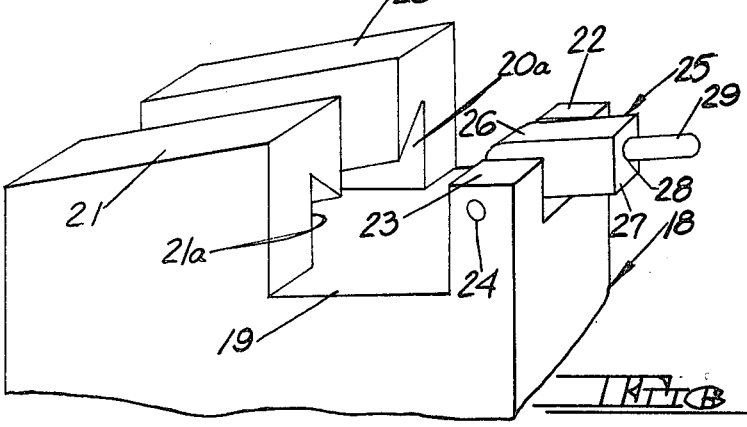
FIG. 2 is a fragmentary perspective view of a base member of the present invention intended for use with the lug of FIG. 1.
Figure 3:
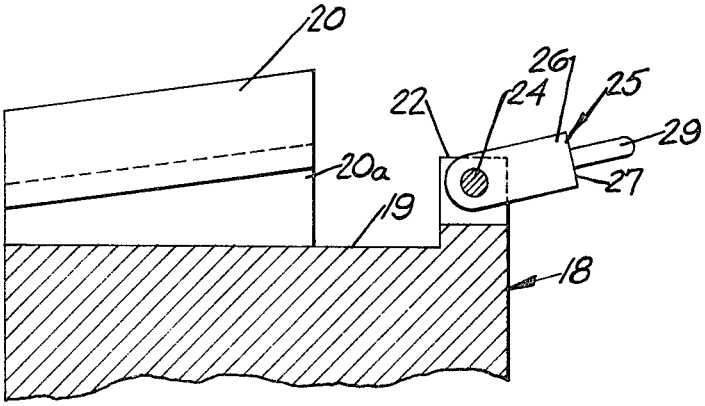
FIG. 3 is a fragmentary elevational view, partly in cross section, of the base member of FIG. 2.
Figure 4A:
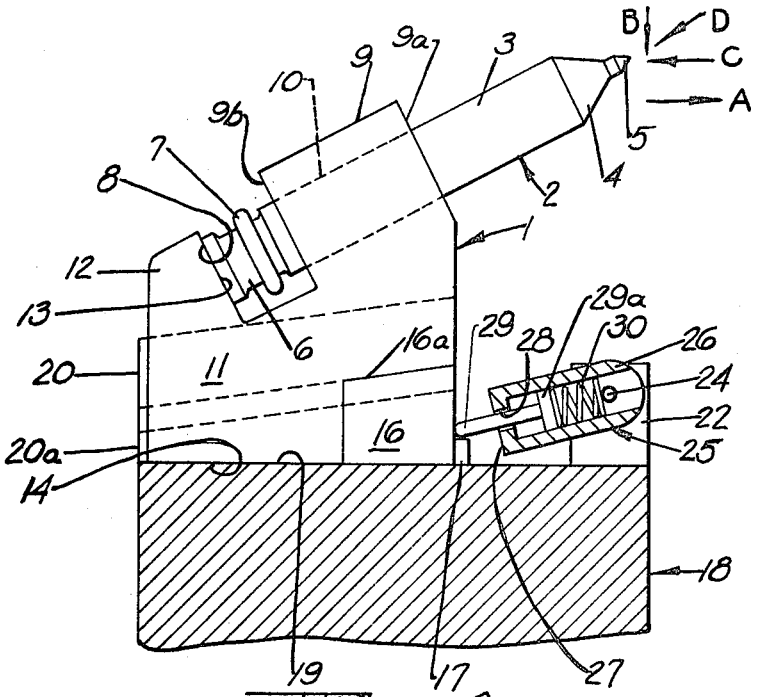
FIG. 4 is a fragmentary elevational view, partly in cross section, illustrating the base member of FIGS. 2 and 3 with the lug of FIG. 1 mounted therein.

FIGS. 2, 3 and 4 illustrate the upper portion of a base member. It will be remembered that the lower portion of the base member is adapted to be permanently affixed to the driven element of a mining machine. The base member is generally indicated at 18 and has a flat upper surface 19 adapted to cooperate with the bottom surface 14 of lug 1. The base member 18 is provided with a pair of upstanding bifurcations 20 and 21 in parallel spaced relationship and extending longitudinally thereof. The bifurcations 20 and 21 are spaced from each other by a distance sufficient to just nicely accommodate the lug body portion 11 therebetween. The bifurcation 20 has an undercut slot 20*a* formed therein. The upper surface of undercut slot 20*a* (most clearly seen in FIG. 3) slopes rearwardly and downwardly at the same angle as the upper surface 15*a* of dovetailed extension 15 of the lug 1. Bifuration 21 is provided with an undercut slot 21*a* constituting a mirror image of slot 20*a* and adapted to accommodate dovetailed lateral extension 16 of lug 1.

The base member 18 has an upstanding pair of bifurcations 22 and 23 located forwardly of bifurcations 20 and 21. Rotatably mounted between bifurcations 22 and 23, by means of pivot pin 24, there is a retaining means generally indicated at 25. As is most clearly shown in FIG. 4, the retaining means 25 comprises a hollow body 26 terminating in a front wall 27 having a perforation 28 therein. The perforation 28 slidably accommodates a plunger 29. The rearward end of plunger 29 is headed as at 29*a*. A compression spring 30 is located between the head 29*a* of plunger 29 and pivot pin 24 and constantly urges plunger 29 to its fully extended position as shown in FIG. 2 and 3.

The assembly of lug 1, base member 18 and retaining means 25 may be described as follows. Retaining means 25 is first pivoted to its inoperative position as illustrated in FIGS. 2 and 3. The distance between base member bifurcations 20 and 21 and base member bifurcations 22 and 23 is slightly greater than the length of lateral extensions 15 and 16 of lug 1. This permits the lug 1 to be located on the base member with its bottom surface 14 lying upon the upper surface 19 of the base member and its body portion 11 accommodated between base member bifurcations 20 and 21. The lug is then shifted rearwardly of the base member so that the dovetailed lateral extensions 15 and 16 of the lug are received within the undercut slots 20*a* and 21*a* of the base member. In this fashion, a wedging relationship is established between the lug 1 and the base member 18. The wedging relationship is a vertical one between the abutment of the lug bottom surface 14 and base member upper surface 19 on the one hand and the abutment of the upper dovetailed surfaces 15*a* and 16*a* of lug extensions 15 and 16 and the corresponding undercut portions of base member slots 20*a* and 21*a*. Once the lug 1 is fully seated within base member 18, the retaining means 25 may be pivoted in a counterclock direction (as viewed in FIGS. 2 through 4) until it reaches its active position illustrated in FIG. 4. To determine its active position, the plunger 29 rests against the front face of lug 1 and the upper surface of the lug extension 17, which serves as a stop for the retaining means. It will be evident from FIG. 4 that when the retaining means is pivoted in a counterclockwise direction from its position shown in FIGS. 2 and 3, it will contact the front surface of lug 1 and will be pushed inwardly until it reaches its maximum retracted position when plunger 29 of retaining means 25 is perpendicular to the front surface of lug 1. The plunger 29 has already begun to shift outwardly again from the body 26 of retaining means 25 when it reaches the upper surface of extension or stop 17. Thus, when in its working position, the retaining means 25 is in an over-center position.

In FIG. 4 the cutting direction is indicated by arrow A. This is the direction in which the lug and base member assembly is shifted against the material being cut by the driven element of the mining machine to which base member 18 is affixed. It will be understood that the term "cutting direction" refers only to the motion imparted to the assembly by the driven element of the mining machine, and is not intended to refer to additional motion imparted to the assembly by the advance of the entire mining machine or by oscillation, traverse or other motion imparted to that part of the mining machine bearing the driven element. At any given instant, as the lug and cutter bit assembly advance in the cutting direction A, the assembly is subject to a number of cutting forces in a plurality of directions. Of the many cutting forces, the two primary ones are a vertical force indicated at arrow B and a horizontal force indicated by arrow C. In an ideal situation, the resultant cutting forces, respresented by arrow D, are essentially parallel to the long axis of the cutter bit. As a practical matter, such an ideal situation cannot be achieved. However, the cutter bit 2 is maintained at an angle by lug 1 so that this situation can at least be approximated.

It will be evident from FIG. 4 that the cutting forces will be taken by the cutter bit abutment surface 8 and the lug abutment surface 13 and by the abutting surfaces of the lug lateral extensions 15 and 16 and the base member bifurcations 20 and 21. These latter lug and base member surfaces will accommodate for any tendency of the entire cutter bit and lug assembly to be rotated in a counterclockwise direction (as viewed in FIG. 4) by the cutting forces. Thus, the retaining means 25 is free of the resultant cutting forces.

To remove lug 1 from base member 18, retaining means 25 is first rotated in a clockwise direction (as viewed in FIGS. 2 through 4) to its inoperative position. Lug 1 can then be shifted forwardly on base member 18 and lifted therefrom.

Figure 5:
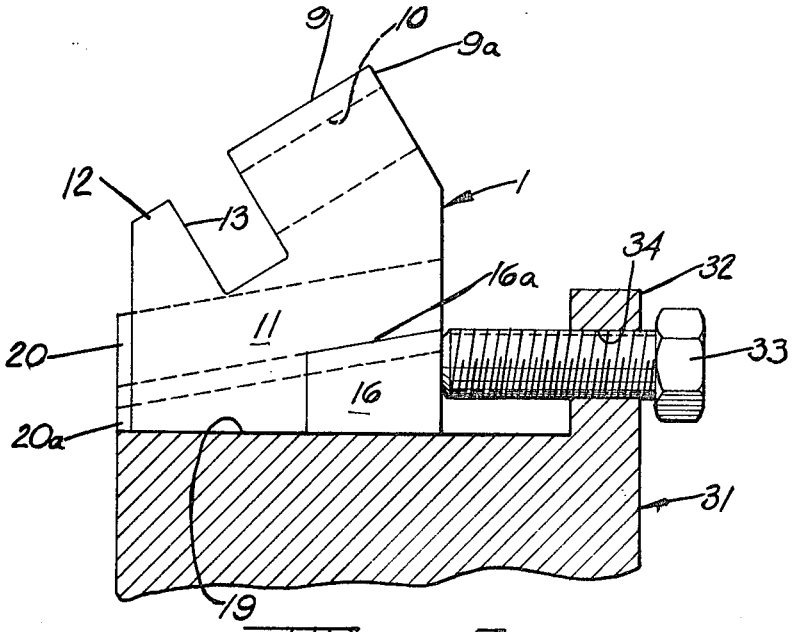
FIG. 5 is a fragmentary elevational view, partly in cross section, illustrating the lug of FIG. 1 mounted in an another embodiment of the base member.

Another embodiment of the present invention is illustrated in FIG. 5. For purposes of an exemplary showing, FIG. 5 illustrates a lug identical to that of FIGS. 1 and 4 and like parts have been given like index numerals. In this embodiment, a base member generally indicated at 31 is used which is substantially identical to that of FIGS. 2 and 3, and like parts have been given like index numerals. Thus, the base member has an upper surface 19 and a pair of bifurcations, one of which is shown at 20. The bifurcations are provided with rearwardly and downwardly sloping under cut slots as described with respect to FIGS. 2 and 3, and one such slot is shown at 20*a*. The cooperation of lug 1 and base member 31 is identical to that described with respect to FIGS. 1 through 4. The base member 31 differs from base member 18 of FIGS. 2 through 4 primarily in that it is provided with an upstanding transverse front wall 32 located at the positions of bifurcations 22 and 23 of base member 18. This front wall extends across the base member and is spaced from the bifurcations 20 and 21 again by a distance slightly greater than the length of the dovetailed extensions 15 and 16 of the lug 1. Thus the lug 1 can be inserted and removed from base member 31 in the same way described with respect to the embodiment of FIGS. 1 through 4.

In the embodiment of FIG. 5, the pivoted retaining means 25 of FIGS. 1 through 4 has been replaced by a retaining means in the form of a bolt 33 passing through a threaded perforation 34 in the front wall 32. Once the lug has been lowered onto the upper surface 19 of the base member and shifted rearwardly so that its lateral dovetailed extensions 15 and 16 achieve their wedging relationship with the base member bifurcations 20 and 21, the retaining bolt 33 is tightened until its free end approaches or abuts the forward end of lug 1. It will be understood that the bolt retaining means 33 of FIG. 5 will be free of the cutting forces for the same reasons given with respect to retaining means 25. To remove lug 1 from the base member 31, it is only necessary to remove bolt 33 or to loosen it until its free end is located within the front wall 34 of the base member so that the lug 1 can be shifted forwardly and then lifted upwardly for removal and replacement.

Figure 6:
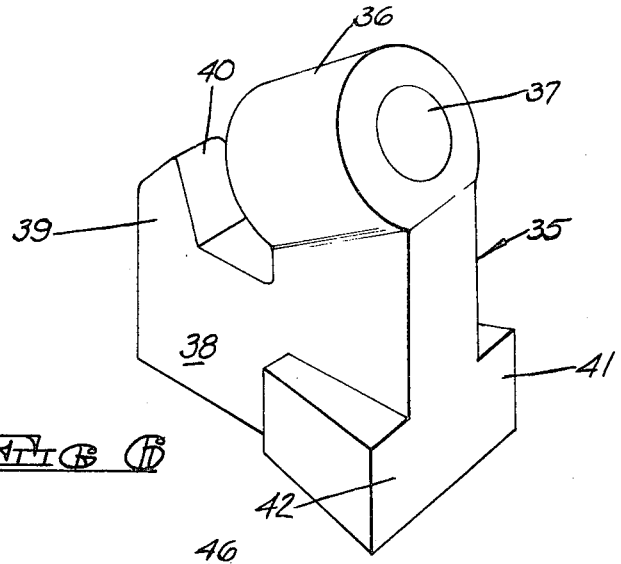
FIG. 6 is a perspective view of another lug of the present invention.

FIG. 6 illustrates another embodiment of a lug of the present invention. The lug is generally indicated at 35 and again is shown as being configured to accept a pick-like bit of the type shown at 2 in FIG. 4. To this end, the lug 35 has a body portion 36 containing a shank receiving perforation 37. The lug has a rearward extension 38 terminating in an anvil portion 39 providing an anvil surface 40. As in the case of lug 1 of FIG. 1, the lug 35 of FIG. 6 is provided with a pair of lateral extensions 41 and 42. In this instance, the lateral extensions 41 and 42 are of the same vertical dimension throughout their length and are not dovetailed. The tapered sides of extensions 41 and 42 taper rearwardly and toward each other.

Figure 7:
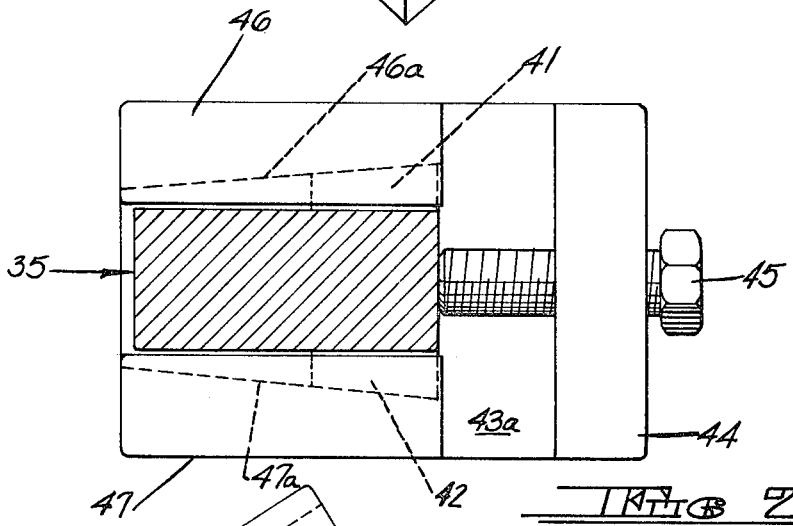
FIG. 7 is a plan view, partly in cross section, of the lug of FIG. 6 mounted in a base member therefore.

FIG. 7 illustrates the lug 35 mounted in a base member generally indicated at 43 and similar in most respects to base member 31 of FIG. 5. To this end, the base member has an upper surface 43*a* equivalent to the upper base member surface 19 of FIG. 5. The base member 43 also has an upstanding, transversely extending front wall 44 identical to front wall 32 of FIG. 5. The front wall 44 has a threaded perforation extending therethrough (not shown) to accommodate a retaining bolt 45 which is identical to retaining bolt 33 of FIG. 5 and operates in the same manner.

The base member 43 has a pair of upstanding bifurcations 46 and 47 which are equivalent to the bifurcations 20 and 21 of the embodiments of FIGS. 2 and 5. The bifurcations 46 and 47 differ, however, from the previously described bifurcations 20 and 21 in that they are provided with slots 46*a* and 47*a* which are not undercut and which are of the same vertical dimensions throughout their length. In this instance, however, the slots taper rearwardly and toward each other so as to accommodate with a wedging action the lateral extensions 41 and 42 of lug 35. Thus, the wedging action between the lug 35 and the base member 43 in the embodiment of FIGS. 6 and 7 is a side-to-side wedging action, rather than a vertical wedging action as described with respect to FIG. 4, for example. The result is essentially the same, and retaining bolt 45 is free of the resultant cutting forces.

In all of the embodiments thus far described, if the abutting surfaces of the base member and the lug become worn so that the base member shifts further rearwardly with respect to the base member, the retaining means may lose contact with the lug (particularly retaining bolts 33 and 45). Nevertheless, the majority of the forces working against the lug will tend to shift it further rearwardly and into constant wedging action with respect to the base member. Even if a force should occur which would tend to shift the lug forwardly with respect to its base member, it cannot become dislodged therefrom by virtue of the presence of the retaining means.

Figure 8:
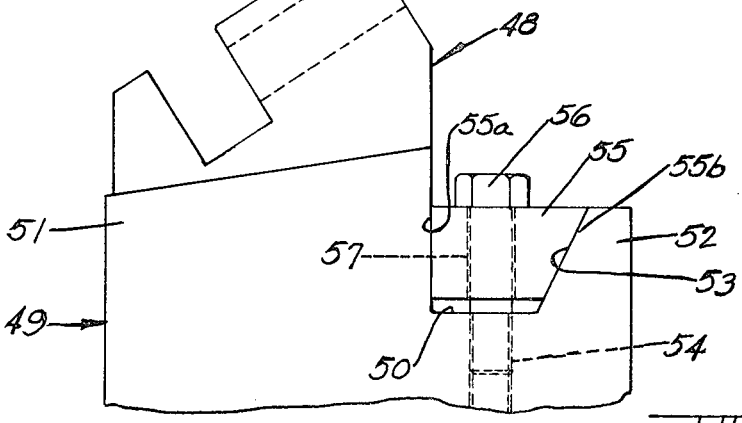
FIG. 8 is a fragmentary elevational view of a base member and retaining means for use with a lug of the type illustrated in FIG. 1 or of the type illustrated in FIG. 6.

Another embodiment of the present invention is illustrated in FIG. 8. In this FIG. a lug is generally indicated at 48 and a base member is shown at 49. The lug 48 may be either of the type shown at 1 in FIG. 1 or of the type shown at 35 in FIG. 6. The base member is similar to those heretofore described, having an upper surface 50 and a pair of bifurcations, one of which is shown at 51. Depending upon the nature of the lug 48, the bifurcations may be either of the type shown at 20 and 21 in FIG. 2 or of the type shown at 46 and 47 in FIG. 7. The base member 49 has a forward transverse front wall 52 spaced from the bifurcations by a distance sufficient to accommodate the lateral extensions of lug 48 so that lug 48 may be lowered into the upper portion of the base member and then shifted rearwardly for a wedging engagement therewith, as has been described in association with the previously illustrated embodiments.

In the embodiment of FIG. 8, the front wall 52 is provided with a surface 53 facing the bifurcations (one of which is shown at 51). The surface 53 slopes upwardly and forwardly. Between the front wall 52 and the bifurcations, the upper surface 50 has a threaded perforation 54 formed therein. The threaded perforation 54 extends vertically downwardly into base member 49. In this embodiment, the retaining means comprises a wedge-shaped block 55 having a vertical rearward face **55*a* opposite the vertical forward faces of the bifurcations and a forward face 55*b* which slopes upwardly and forwardly and corresponds to the rear face 53 of front wall 52. As will be evident from FIG. 8, once the lug 48 is located in and fully seated in the upper end of base member 49, the block 55 may be located in place as shown and held therein by a bolt 56 passing through a clearance hole 57 in block 55 and threadedly engaged in the hole 54 in base member 49**.

Once in place, the block 55 will prevent undesired disengagement of lug 48 from base member 49. In order to replace the lug 48, it is only necessary to unbolt and remove block 55, whereupon lug 48 can be shoved forwardly of base member 49 and then lifted upwardly for removal.

As indicated above, only that portion of each lug of the present invention which cooperates with the upper portion of its base member and with the retaining means constitutes a specific part of the present invention. The remainder of the lug, dictated by the type of cutter bit to be held thereby, does not constitute a limitation. To very clearly illustrate this, reference is made to FIG. 9 wherein a lug is generally indicated at 58. This lug comprises a block-like body 59 provided with lateral extensions 60 and 61. The lateral extensions 60 and 61 are the full equivalent of lateral extensions 15 and 16 of lug 1 of FIG. 1 and their upper surfaces **60*a* and 61*a* slope rearwardly and downwardly and are dovetailed, as described with respect to the structure of FIG. 1. The lug 58**, however, is illustrated as being of the type adapted to accommodate the well known cutter bits taught in U.S. Pat. No. 3,114,437.

Figure 9:
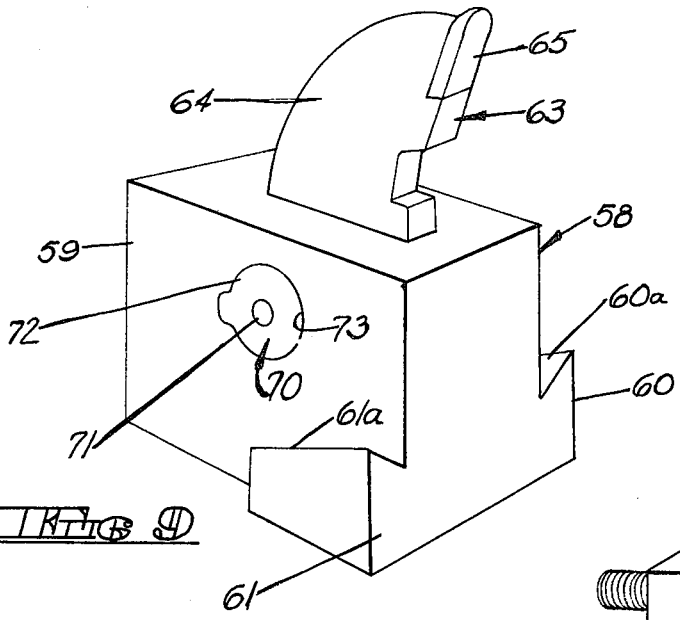
FIG. 9 is a perspective view of a lug similar to that of FIG. 1 but adapted to carry a different type of cutter bit.
Figure 12:
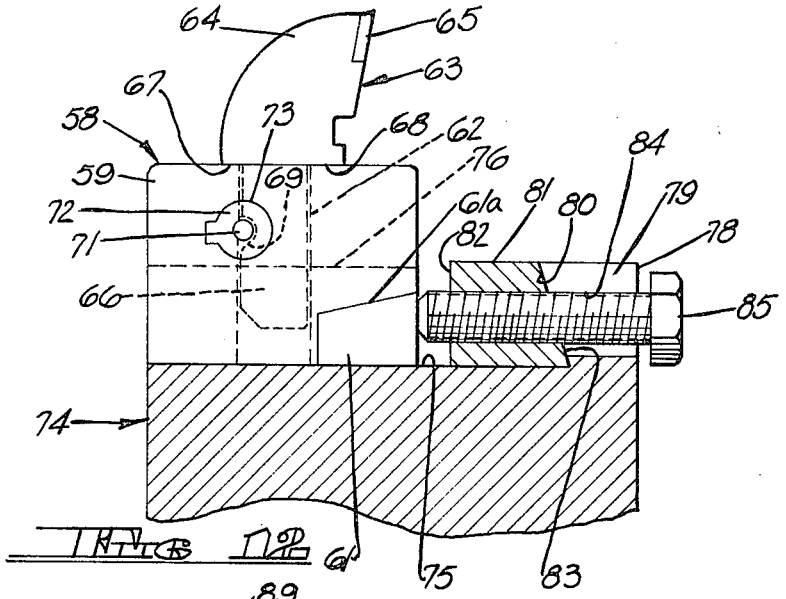
FIG. 12 is a fragmentary elevational view, partly in cross section, illustrating the assembly of the lug of FIG. 9, base member of FIG. 10 and retaining means of FIG. 11.

Briefly, lug 58 is provided with a vertically oriented shank receiving perforation 62 having a rectangular cross sectional configuration (see FIGS. 9 and 12). The cutter bit 63 comprises a head portion 64 with a hard cutting tip 65 and a downwardly depending shank 66. The head portion 64 has gauge determining abutment shoulders 67 and 68 adapted to cooperate with the top surface of lug 58. The rear edge of cutter bit shank 66 may be provided with a hook-shaped notch 69 of the type taught in U.S. Pat. No. 3,114,537 to accommodate a resilient retaining means 70 of the type taught in the same patent.

Briefly, the retaining means comprises a pin 71 located in a body of resilient material 72. The retaining means 70 is located in a transverse perforation 73 in the lug 58. The transverse perforation 73 partially intersects the shank receiving perforation 62 so that the pin 71 may engage the notch 69 in the bit shank 62 to maintain the cutter bit 63 in its seated position during the cutting operation.

Figure 10:
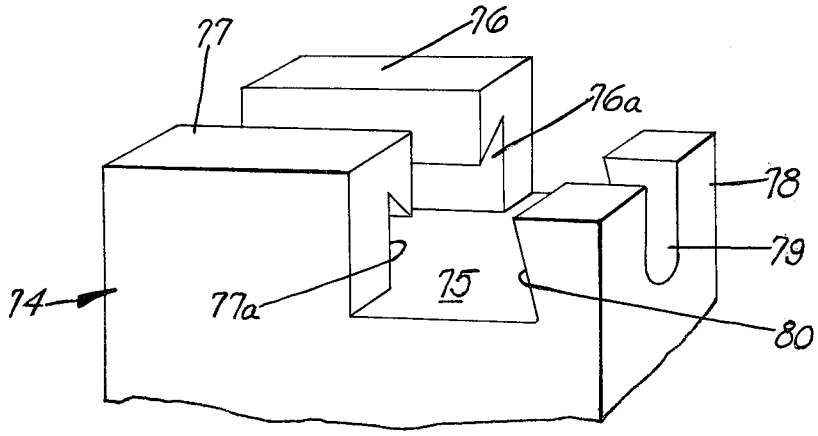
FIG. 10 is a fragmentary perspective view of another embodiment of a base member.

Now it will be understood that the lug of FIGS. 9 and 12 could be used with any of the base members of FIGS. 2 through 5 and 8. Another embodiment of a base member, however, is illustrated in FIGS. 10 and 12. The base member, generally indicated at 74 has an upper surface 75 equivalent to the upper surface 19 of base member 18 of FIG. 2. The base member 74 is also provided with a pair of bifurcations 76 and 77 having undercut notches **76*a* and 77*a*, equivalent to the bifurcations 20 and 21 and undercut notches 20*a* and 21*a* of base member 18 of FIG. 2. Thus it will be apparent that the engagement of lug 58 of FIG. 9 in the base member 74 of FIG. 10 will be the same as described with respect to lug 1 and base member 18 (see FIG. 4). This is illustrated in FIG. 12**.

The base member 74 is provided with a forward transverse wall 78. The wall 78 has a vertical notch 79 formed therein. That surface 80 of the wall 78 which faces bifurcations 76 and 77 is undercut, as is shown clearly in FIGS. 10 and 12. It will be understood that the wall 78 is spaced forwardly of bifurcations 76 and 77 by a distance sufficient to accommodate the lateral extensions 60 and 61 of lug 58 so that the lug may be lowered to the upper surface 75 of base member 74 and then shifted rearwardly to accomplish a wedging engagement therewith.

Figure 11:
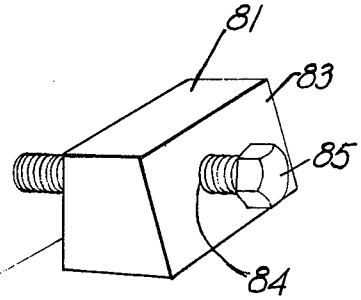
FIG. 11 is a perspective view of a retaining means for use with the base member of FIG. 10.

The retaining means for this embodiment is shown in FIGS. 11 and 12. The retaining means comprises a block 81 having a vertical rear surface 82 and a forwardly and downwardly sloping front surface 83 corresponding to the undercut surface 80 of front wall 78. While the block 81 may be configured to completely fill the space between front wall 78 and bifurcations 76 and 77, necessitating the insertion of block 81 therebetween from the side of base member 74, it is preferred that the widest front to rear dimension of block 81 be such as to permit it to be lowered into the space between front wall 78 and bifurcations 76 and 77. This is illustrated in FIG. 12.

The block 81 has formed therein a threaded perforation 84 adapted to be threadedly engaged by a bolt 85. Thus, once the lug 58 has been fully seated in base member 74, the block 81 and its bolt 85 may be located in place, the bolt 85 extending through the notch 79 in front wall 78. Upon tightening the bolt, its free end will approach or contact the forward surface of lug 58. At the same time, the sloping surface 83 of block 81 will abut the undercut surface 80 of wall 78 locking the retaining means assembly in place. Sufficient loosening of bolt 85 will enable removal of block 81 so that the lug 58 may be removed and replaced, as required.

Figure 13:
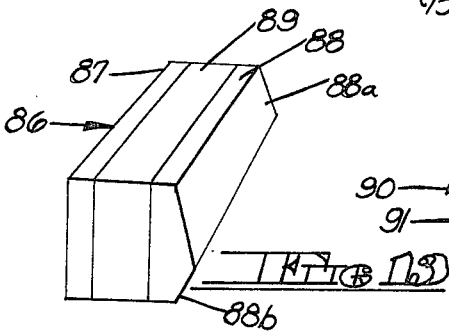
FIGS. 13 and 14 are perspective views of alternative retaining means which can be used with the base member of FIGS. 10 and 12.

FIG. 13 illustrates an alternate form of retaining means for use with the base member 74 of FIGS. 10 and 12. The retaining means is generally indicated at 86 and comprises a wedge-like block made up of a rear metallic, rectangular plate 87, a forward rectangular metallic plate 88 and an intermediate block of resilient material 89. The elements 87, 88 and 89 are permanently adhered together.

The retainer 86 of FIG. 13 is so sized as to completely fill the space between bifurcations 76 and 77 and front wall 78 of the base member 74 (FIGS. 10 and 12). Since the center portion 89 of the retaining means is resilient, the retaining means may be located above the area it is intended to fill and may be pounded into place. It will be noted that the front portion 88 of the retaining means has a first downwardly and forwardly sloping portion 88*a* intended to abut the undercut surface 80 of front wall 78 of the base member. The front portion 88 of the retaining means has an oppositely angled surface 88*b*. This surface 88*b* serves as a cam surface when the retaining means 86 is pounded in place, the surface 88*b* cooperating with the upper rear corner of base member wall 78 to compress the retaining means enabling it to be forced into the space between bifurcations 76 and 77 and wall 78.

Figure 14:
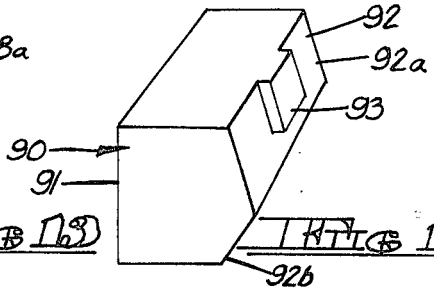

FIG. 14 shows another alternative retaining means, generally indicated at 90. This retaining means is substantially the same as retaining means 86 of FIG. 13 with the primary exception that it constitutes a single, unitary, one-piece block of resilient material. The retaining means 90 has a substantially vertical rear surface 91 and a forward surface 92 having an upper porton 92*a* equivalent to the surface portion 88*a* of retaining means 86 and a lower surface portion 92*b* equivalent to the lower surface portion 88*b* of retaining means 86.

The retaining means 90 may be provided on its surface portion 92*a* with a centrally located lug or extension 93. This extension or lug is adapted to cooperate with the slot 79 in the front wall 78 of base member 74 to prevent lateral shifting of retaining means 90. It will be understood that the retaining means 86 of FIG. 13 could be provided with a similar integral lug or extension (not shown).

Figure 15:
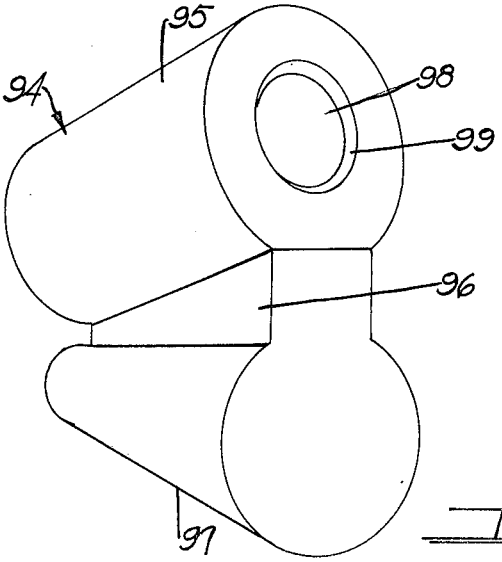
FIG. 15 is a perspective view of yet another lug.
Figure 16:
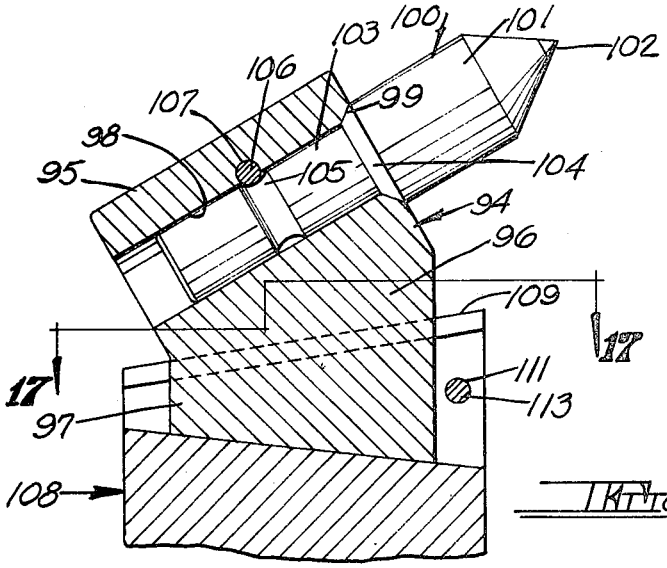
FIG. 16 is a fragmentary elevational view, partly in cross section, illustrating the lug of FIG. 15 and a base member and retaining means therefor.

Yet another form of cutter bit lug is illustrated in FIG. 15. The lug of FIG. 15 is generally indicated at 94 and comprises an upper body portion 95, an intermediate body portion 96 and a lower body portion 97. While the upper body portion 95 may take any configuration appropriate to the cutter bit it is intended to mount, for purposes of an exemplary showing it is illustrated as being substantially cylindrical and having a central shank receiving perforation 98. At the point where the shank receiving perforation 98 opens at the forward face of the portion 95, the shank receiving perforation flares upwardly and outwardly to form an annular, conical shoulder 99. FIG. 16 illustrates an exemplary cutter bit for use with lug 94. Such a cutter bit is usually referred to as a "plumb bob" bit. The bit, generally indicated at 100, comprises an enlarged head portion 101 terminating in a cutting tip 102. The bit also has a cylindrical shank 103 adapted to be received in and to be rotatable in shank receiving perforation 98. Between the head portion 101 and the shank portion 103 of the bit, there is formed a gauge determining abutment shoulder 104 which is conical or tapered so as to cooperate with the abutment shoulder 99 of lug 94. Many means have been devised to retain such cutter bits in their respective lugs. An exemplary, but nonlimiting, example is the formation of an annular notch 105 in the cutter bit shank 103 and a retaining pin 106 (suchy as a roll pin) extending through a transverse perforation 107 in the body portion 95 of lug 94. The transverse perforation 107 intersects the shank receiving perforation 98 in such a way that the roll pin 106 will extend into the annular notch 105 in the cutter bit shank. This arrangement permits free rotation of the cutter bit, but will preclude its removal from shank receiving perforation 98 until the roll pin 106 is removed.

Returning to FIG. 15, the intermediate body portion 96 of lug 94 is of uniform thickness throughout its length. The lower body portion 97 of lug 94 is essentially of circular cross section and is uniformly tapered throughout its length from the front of the lug to the rear thereof.

Figure 17:
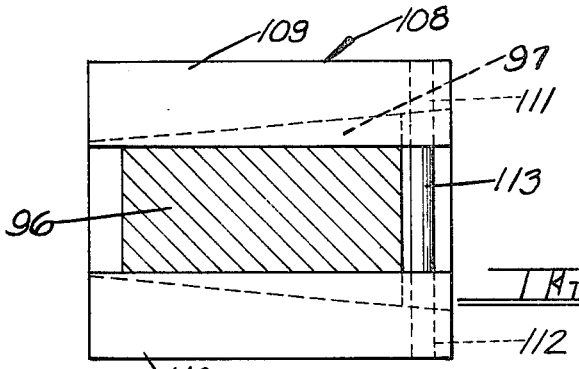
FIG. 17 is a cross sectional view taken along section line 17—17 of FIG. 16.

A base member for use with the lug 95 of FIG. 15 is generally indicated at 108 in FIGS. 16 and 17. The base member 108 comprises a block-like element with a pair of upstanding bifurcations 109 and 110. At their upper edges, the bifurcations are parallel and spaced from each other by a distance sufficient to accommodate the intermediate portion 96 of lug 94. Therebelow, the bifurcation walls and the base member surface therebetween are configured to just nicely receive the lower portion 97 of lug 94 in a wedging engagement. Thus, the bifurcations 109 and 110 and that portion of the base member therebetween form a continuous, tapered, substantially conical surface or cavity corresponding to the exterior surface of lug lower portion 97.

In order to retain the lug in place within base member 108, the bifurcations 109 and 110 may be provided with coaxial perforations 111 and 112, respectively. These perforations are adapted to receive a roll pin 113 or other rod-like retaining means which, as is evident from FIGS. 16 and 17, will prevent the lug 94 from being disengaged from base member 108. Again it will be evident that the retaining pin 113 (as is true of all of the retaining means thus far described) will be free of resultant cutting forces.

Figure 18:
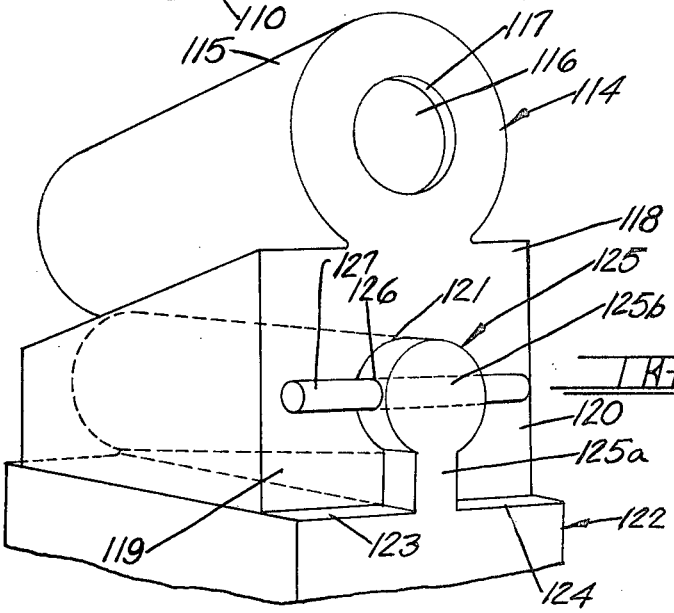
FIG. 18 is a fragmentary perspective view of a lug and base member having an interengagement opposite that illustrated in FIGS. 16 and 17.

FIG. 18 illustrates an embodiment which, in essence, constitutes just the opposite of that embodiment illustrated in FIGS. 15 through 17. Here, a lug (generally indicated at 114) has an upper portion 115 substantially identical to the upper portion 95 of lug 94. The upper portion 115 is provided with a shank receiving perforation 116 having an annular shoulder 117 of the same type described with respect to lug 94 of FIG. 15, and for the same purposes.

The bottom portion 118 of lug 114 is block-like and bifurcated. The bifurcations 119 and 120 have lower edges which are facing and parallel. The inside facing surfaces of the remainder of the bifurcations and the adjacent surface of the block-like portion 118 extending therebetween form a continuous, tapered, substantially conical cavity 121 the larger end of which is to the rear of lug 114 and the smaller end of which is to the front.

A base member for lug 114 is generally indicated at 122 in FIG. 18 and comprises a block-like structure having flat upper surfaces 123 and 124 extending from the front thereof to the rear. Between these surfaces there is an upstanding extension, generally indicated at 125, and extending from the forward surface to the rearward surface of base member 122. The lowermost portion 125*a* of extension 125 has parallel vertical sides which extend the length of the base member. The upper portion 125*b* of extension 125 is tapered and substantially conical with its smaller diameter to the front of base member 122 and its larger diameter to the rear. The extension 125 is adapted to be received in the cavity 121 of the lower portion 118 of cutter bit lug 114 with a wedging engagement. The forwardmost end of the base member extension 125 is exposed and may be provided with a transverse perforation 126 adapted to receive a roll pin or similar device 127. Again, it will be apparent that the retaining roll pin 127 will be free of the resultant cutting forces.

Installation and removal of both the embodiment of FIGS. 15 through 17 and the embodiment of FIG. 18 is simply a matter of engaging the lower portion of the lug with its base member and shoving rearwardly until a wedging engagement is achieved. At this point, the roll pin 113 of the embodiment of FIGS. 15 through 17 or the roll pin 127 of the embodiment of FIG. 18 may be inserted, completing the installation. Both types of lugs can readily be shoved forwardly and disengaged from their respective base members upon removal of their respective retaining roll pins.

Figure 19:
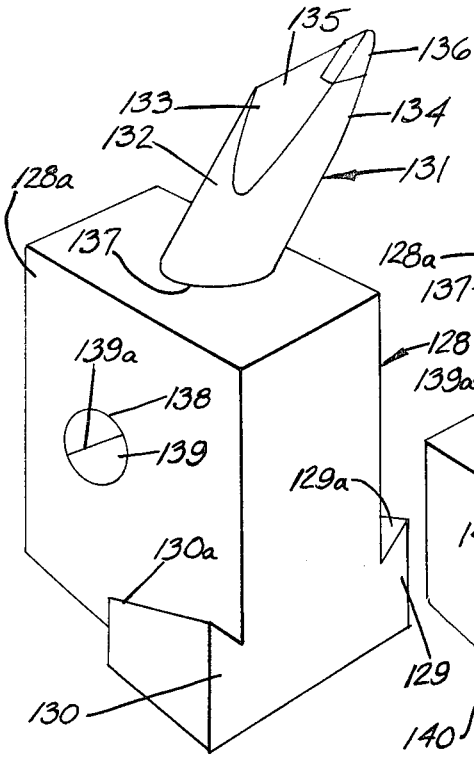
FIG. 19 is a perspective view of a lug similar to that of FIG. 1 but intended to carry a different type of cutter bit.

FIG. 19 illustrates another lug, generally indicated at 128. Lug 128 is similar to lug 1 of FIG. 1 and lug 58 of FIG. 9, being provided with lateral extensions 129 and 130. Once again, the lateral extensions 129 and 130 have upper surfaces 129*a* and 130*a* which are dovetailed and which slope downwardly and rearwardly of the lug. Thus, the lug 128 could be used in the base member 18 of FIG. 2, the base member 31 of FIG. 5, the base member 52 of FIG. 8 or the base member 74 of FIG. 10. The lug 128 differs from lug 1 of FIG. 1 or lug 58 of FIG. 9 only in that its upper body portion 128*a* is configured to mount a cutter bit of the type taught in U.S. Pat. No. 3,690,728.

Such a cutter bit is generally indicate at 131. The cutter bit has a shank portion 132 which may be of any suitable cross section. Preferably, the cutter bit is made from round stock. At its upper end, the cutter bit is relieved as at 133 and 134 and is provided with a clearance angle as at 135. The uppermost forward end of the cutter bit may be provided with a hard cutting tip 136. The other end of the cutter bit shank terminates in an abutment surface which slopes rearwardly and downwardly. In fact, the cutter bit may be double-ended, the bottom end being identical to that end illustrated in FIG. 19 and that portion of the cutter bit constituting the clearance angle 135 serving as an abutment surface.

Lug 128 has a shank receiving perforation 137 formed therein and of an appropriate cross section as to just nicely receive the shank 132 of cutter bit 131. The bottom of the shank receiving perforation 137 is intersected by a transverse perforation 138 in which a half pin 139 is provided. The rearwardly and downwardly sloping surface 139*a* of pin 139 constitutes an abutment surface adapted to cooperate with the cutter bit abutment surface. This cooperation of the cutter bit and lug abutment surfaces serves several purposes. First of all, it causes the resultant cutting forces to urge the bit to its fully seated position. It also prevents rotation of the cutter bit when made of round stock, and causes the rearward peripheral surface of the cutter bit and the corresponding surface of the shank receiving perforation to have surface-to-surface or full line contact with each other. Various types of retaining means may be used to maintain the cutter bit 131 in lug 128, as is taught in the above mentioned U.S. Pat. No. 3,690,728.

Figure 20:
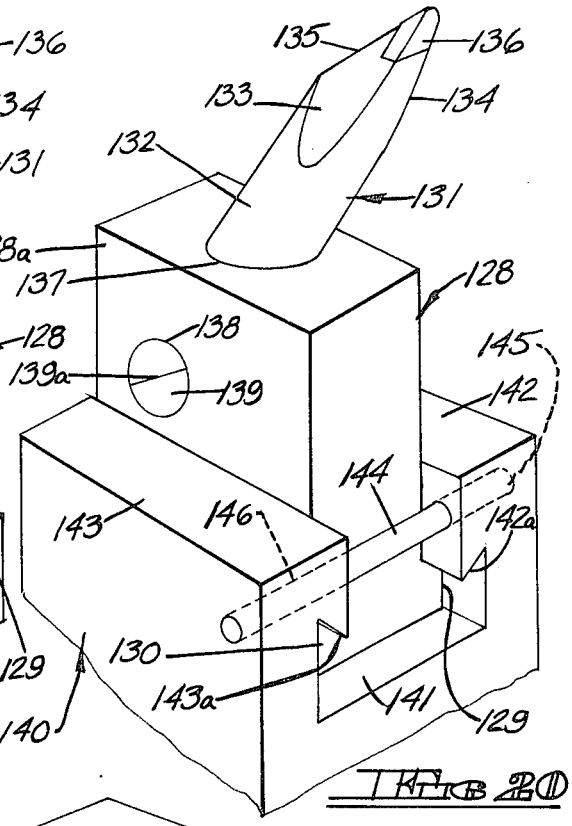
FIG. 20 is a fragmentary perspective view illustrating the lug of FIG. 19 and a base member and retaining means therefore.

FIG. 20 illustrates a base member for the lug of FIG. 19. The base member is generally indicated at 140 and comprises a block-like structure having an upper surface 141 and a pair of parallel bifurcations 142 and 143 which are provided with undercut slots 142*a* and 143*a* throughout their length, the undercut slots being of the type described at 20*a* and 21*a* in base member 18 of FIGS. 2 and 3. The engagement of lug 128 in base member 140 can be accomplished by simply shoving the lug 128 rearwardly of base member 140 and between bifurcations 142 and 143. A wedging relationship will be accomplished between lug 128 and base member 140 in the same manner described with respect to the structures of FIG. 4. Once the lug is fully seated in the base member, a retaining pin 144 or the like may be located in a pair of coaxial perforations 145 and 146 located in bifurcations 142 and 143, respectively. The roll pin or retaining pin 144 operates in precisely the same manner described with respect to retaining pin 113 of FIGS. 16 and 17.

Figure 21:
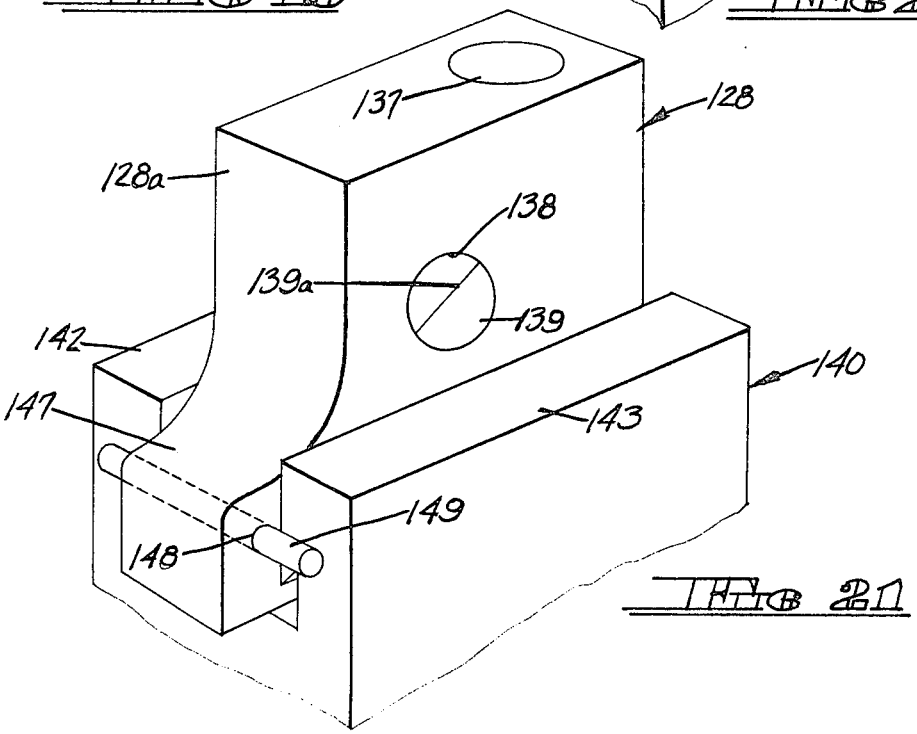
FIG. 21 is a fragmentary perspective view illustrating a modified version of the lug and base member of FIG. 20.

FIG. 21 illustrates a slight modification which can be made to the lug 128 and base member 140. The base member 140 is identical to that shown in FIG. 20 except that it is not provided with the transverse coaxial perforations 145 and 146. The lug 128 of FIG. 21 is identical to that shown in FIG. 19 with the exception that it has been provided with a rearward extension 147 which is located beyond the rearward surface of base member 140. The rearward extension 147 of lug 128 has a transverse perforation 148 passing therethrough. A retaining pin 149, in the form of a roll pin or the like, is located in the transverse perforation 148 once the lug has been fully seated in the base member 140. It will be evident from FIG. 21 that the retaining pin 149 will prevent inadvertent removal of lug 28 from base member 140 and will be free of the resultant cutting forces.

Figure 22:
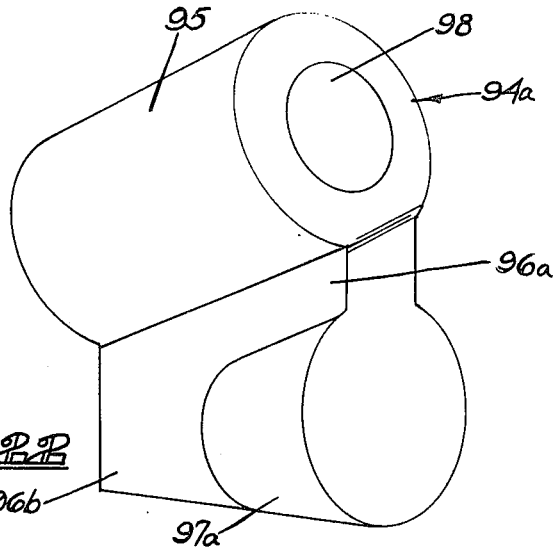
FIG. 22 is a perspective view illustrating a modification of the lug of FIG. 15.
Figure 23:
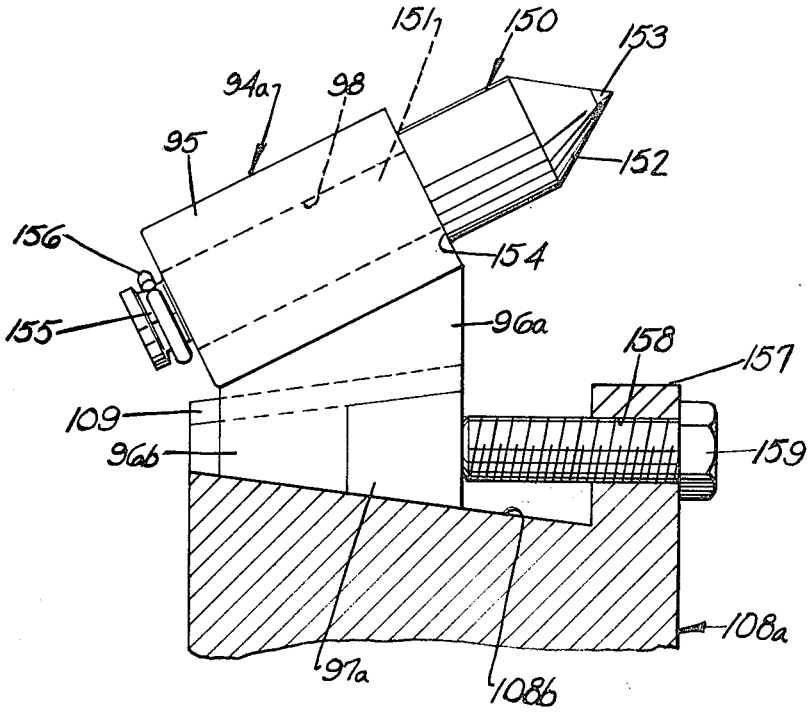
FIG. 23 is a fragmentary elevational view, partly in cross section, illustrating the lug of FIG. 22 mounted in a base member of the general type illustrated in FIG. 16 and modified to have a retaining means of the type shown in FIG. 5.

FIGS. 22 and 23 illustrate a modification of lug 94 and base member 108 of FIGS. 15 through 17. Where applicable, like parts have been given like index numerals. The lug of FIG. 22 is generally indicated at 94*a* and comprises an upper portion 95 an intermediate portion 96*a* and a lower portion 97*a*. The upper portion 95 is substantially identical to that shown in FIG. 15, being provided with a shank receiving perforation 98. In this particular instance, no annular, conical shoulder 99 is provided. The bottom portion 97*a* of the lug 94*a* is the same as the bottom portion 97 of the lug 94 of FIG. 15 with the exception that it only extends partway toward the rear of the lug. The remainder of the lug constitutes a continuation of the intermediate portion 96*a*, as at 96*b*. For purposes of an exemplary shown only, the lug 94*a* is illustrated in FIG. 23 as being provided with a plumb bob-type bit, generally indicated at 150. The bit 150 has a shank 151 of circular cross section and so sized as to be just nicely received in shank receiving perforation 98 and to be rotatable therein. The shank portion 151 terminates at its forward end in a head portion 152 which may be provided with a hard cutting tip 153. The diameter difference between the head portion 152 and shank portion 151 forms an annular shoulder 154 which is adapted to abut the forward surface of the upper portion 95 of lug 94*a* so as to determine the gauge of the cutter bit. The cutter bit may be provided with any appropriate means to retain it in the shank receiving perforation, as for example the means shown and described in FIG. 16. For purposes of an exemplary showing, the shank 151 is illustrated as extending beyond the rear surface of the upper portion 95 of lug 94*a*. That portion of the shank which extends beyond the rearward surface of the lug is provided with an annular notch 155 for receipt of a removable split metal ring 156. The split metal ring serves the same purpose as split metal ring 7 of FIG. 4. The outside diameter of split metal ring 156 is greater than the diameter of shank receiving perforation 98.

FIG. 23 illustrates a base member 108*a* which is identical in most respects to base member 108 of FIG. 16 and like parts have been given like index numerals. Thus, the base member is provided with a pair of bifurcations, one of which is shown at 109. The bifurcations are in parallel spaced relationship and their uppermost facing surfaces are spaced by a distance sufficient to accommodate the intermediate portion 96*a* of lug 94*a*. The remainder of the bifurcations' inner surfaces and the joining upper surface 108*b* of base member 108*a* form a conical socket or cavity adapted to receive the lower portion 97*a* of lug 94*a* with a wedging engagement.

The base member 108*a* differs from base member 108 of FIG. 16 primarily in that it has a forward extension providing a front transverse wall 157. The wall 157 is provided with a threaded perforation 158 adapted to receive a retaining bolt 159. It will be understood that any of the retaining means thus far described could be applied to the structure of FIG. 23 and, as an example, the retaining means illustrated in FIG. 23 is equivalent to that described with respect to FIGS. 5 and 6.

Figure 24:
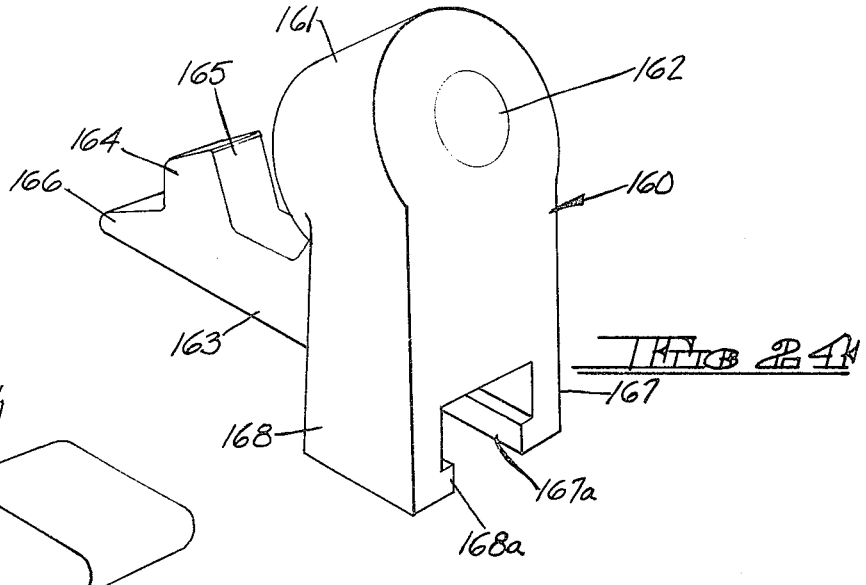
FIG. 24 is a perspective view of yet another lug.
Figure 25:
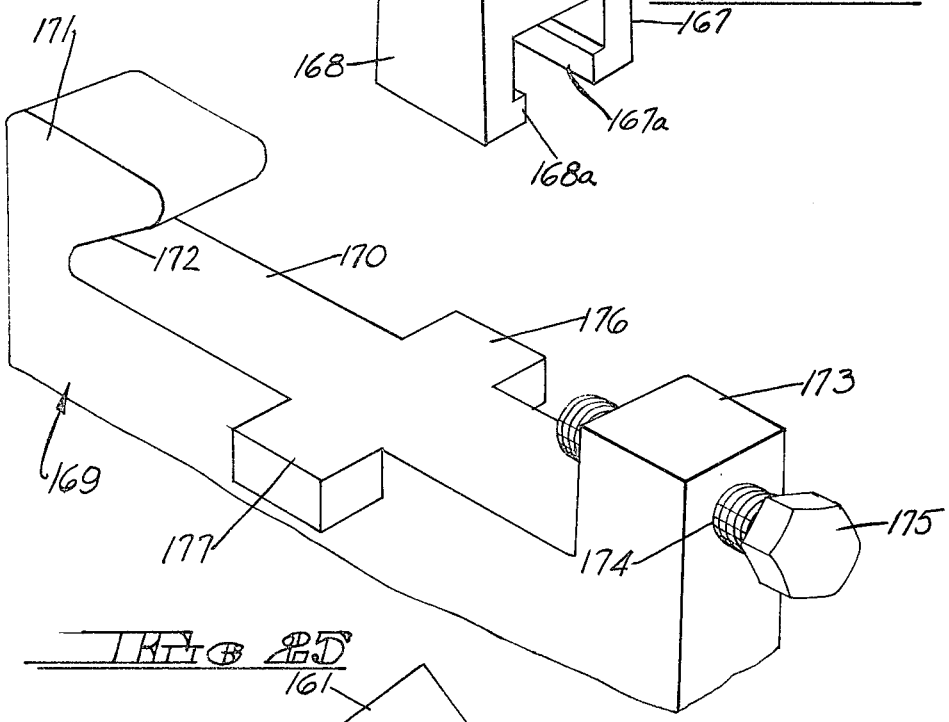
FIG. 25 is a fragmentary perspective view of a base member for use with the lug of FIG. 24.
Figure 26:
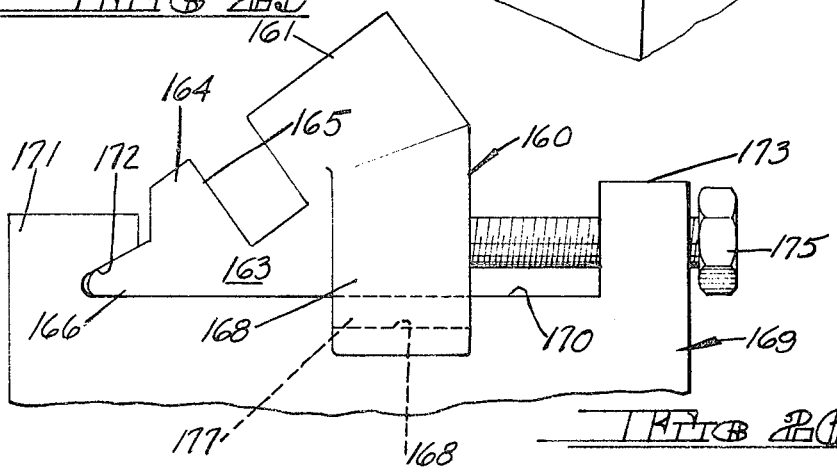
FIG. 26 is a fragmentary elevational view illustrating the lug of FIG. 24 mounted in the base member of FIG. 25.

Reference is now made to FIGS. 24 through 26 wherein another embodiment of the present invention is illustrated. Turning first to FIG. 24, the lug of this embodiment is generally indicated at 160. While the lug may be of any of the types heretofore described, it is again, for purposes of illustration, shown as being of the type to accommodate a picktype bit as shown at 2 in FIG. 4. To this end, the lug 160 has a body portion 161 with a shank receiving perforation 162. The lug has a rearward extension 163 with an upstanding anvil portion 164 presenting an anvil surface 165. Rearwardly of anvil portion 164 the lug has a wedge-shaped extension 166, the purpose of which will be described hereinafter. It will be noted that the extended portion 163 of the lug and the wedge shaped portion 166 are narrower than body portion 161.

Body portion 161 has a pair of downwardly depending arms 167 and 168. The arms 167 and 168 are in parallel spaced relationship, being spaced from each other by a distance greater than the width of the extended lug portion 163 and wedge shaped portion 166. The arms 167 and 168 terminate in inturned flanges 167*a* and 168*a*, respectively. Again, the purposes of the arms and their inturned flanges will be described hereinafter.

FIG. 25 illustrates a base member for the lug 160 of FIG. 24. The base member is generally indicated at 169 and comprises an elongated structure having an upper surface 170 which is substantially planar. At its rearward end, the base member has an upstanding element 171 which is undercut as at 172. At its forward end, the base member has another upstanding element 173 having a threaded perforation 174 extending therethrough and adapted to receive a retainer bolt 175. Finally, between the upstanding elements 171 and 173 of the base member there are a pair of lateral extensions 176 and 177. The upper surfaces of lateral extensions 176 and 177 are substantially coplanar with the upper surface 170 of the base member.

The coaction of lug 160 of FIG. 24 and base member 169 of FIG. 25 is clearly illustrated in FIG. 26. The distance between the upstanding forward portion 173 of base member 169 and the lateral extensions 176 and 177 of the base member is such as to permit the downwardly depending arms 167 and 168 of the lug body portion 161 to be located therebetween, with the arms 167 and 168 straddling the base member. The lug is then shoved rearwardly of the base member until the downwardly depending arms 167 and 168 and their inturned flanges 167*a* and 168*a* engage the base member lateral extensions 166 and 167. Simultaneously, the wedge shaped extension 166 of lug 160 will enter the undercut 172 of base member 169 having a wedging engagement therewith. This is shown in FIG. 26 wherein the lug 160 is illustrated in its fully seated position on base member 169. At this point, the retainer bolt 175 may be tightened so as to approach or engage the forward surface of lug 160. Thus, the lug 160 cannot be removed from base member 169.

It will be understood that the engagement between lug arms 167 and 168 and their inturned flanges 167*a* and 168*a* and the base member lateral extensions 176 and 177, in combination with the wedging engagement of the wedge shaped portion 166 of the lug and the undercut 172 of the base member, will assure that the lug and base member will sustain the resultant cutting forces and that the retaining bolt 175 will be free thereof. To remove and replace lug 160, it is only necessary to remove or retract bolt 175 by a sufficient amount to enable the lug 160 to be shifted forwardly on the base member 169 until the engagement between the lug arms 167 and 168 and the base member extensions 176 and 177 no longer exists. At this point, the wedge shaped portion 166 of the lug will be free of the undercut 172 of the base member. The lug can then be lifted away from the base member for replacement.

Figure 27:
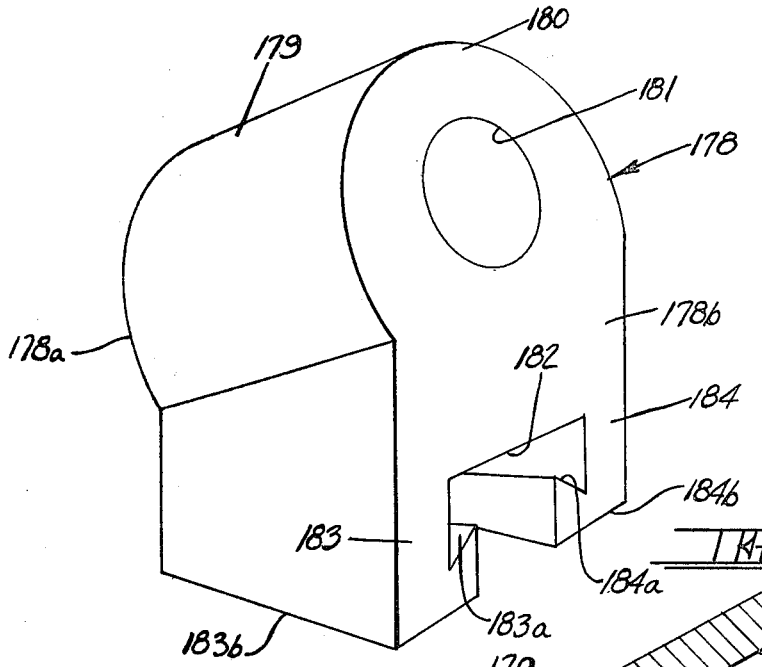
FIG. 27 is a perspective view of yet another lug.
Figure 28:
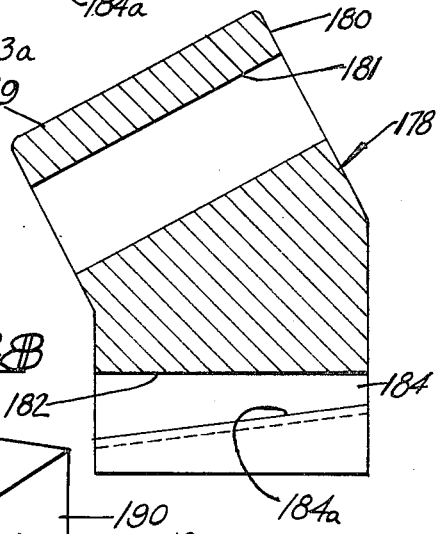
FIG. 28 is a longitudinal cross sectional view of the lug of FIG. 27.

Another exemplary cutter bit lug is generally indicated at 178 in FIGS. 27 and 28. Once again, the upper portion of the lug is illustrated as suitable for use with a plumb bob bit of the type shown in FIG. 23. To this end, the lug has an upper body portion 179 with a forward face 180 serving as a gauge-determining abutment for a cutter bit. The upper portion 179 of cutter bit 178 has a shank receiving perforation 181 extending therethrough. The bottom surface 182 of the lug 178 is substantially horizontal and planar. The lug is provided with two downwardly depending legs 183 and 184. The legs 183 and 184 have facing extensions 183*a* and 184*a* on their inside surfaces. These facing extensions are mirror images of each other and are in parallel spaced relationship. The upper surfaces of extensions 183*a* and 184*a* are dovetailed and slope rearwardly and downwardly throughout their length. This is most clearly seen in FIG. 28 wherein leg 184 and its extension 184*a* are seen in elevation.

Figure 29:
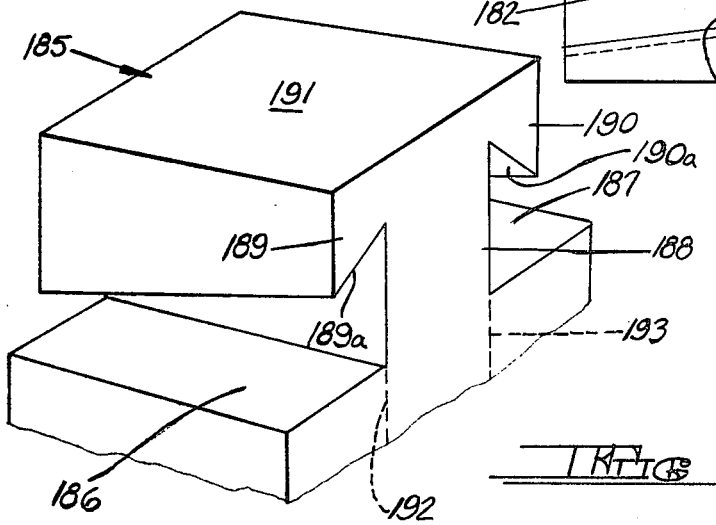
FIG. 29 is a fragmentary perspective view of a base member for use with the lug of FIG. 27 and 28.

FIG. 29 illustrates a base member for lug 178 of FIGS. 27 and 28. The base member is generally indicated at 185. The base member is a block-like structure having substantially horizontal, coplanar upper surfaces 186 and 187. Separating the surfaces 186 and 187 is an upstanding portion 188 having parallel vertical sides. At the top of portion 188 the base member is provided with a pair of lateral extensions 189 and 190. These extensions are mirror images of each other. Their undersides are undercut and slope rearwardly and donwardly. It will be noted that the upper surface 191 of the base member is essentially horizontal and planar.

It will be evident from FIGS. 27 through 29 that the lug 178 may be slipped onto the upper portion of base member 185 in a direction from front to rear thereof. The undercut and rearwardly and downwardly sloping surfaces 189*a* and 190*a* of the extensions 189 and 190 of the base member will cooperate with the dovetailed rearwardly and downwardly sloping surfaces 183*a* and 184*a* of lug legs 183 and 184 to form a vertical wedging action between these elements and the upper surface 191 of the base member and the bottom surface 182 of the lug, which will be in abutment. There may also be a wedging action between the surfaces 186 and 187 on the one hand, and the lowermost surfaces 183*b* and 184*b* on the other hand, as occasioned by engagement of the surfaces 183*a*, 184*a* with surfaces 189*a*, 190*a* respectively. The broken lines 192 and 193 in FIG. 29 are intended simply to indicate that the base member from extensions 189 and 190 on down need only be as wide as the portion 188 and those portions of the base member terminating in upper surfaces 186 and 187 could be eliminated, if desired.

Figure 30:
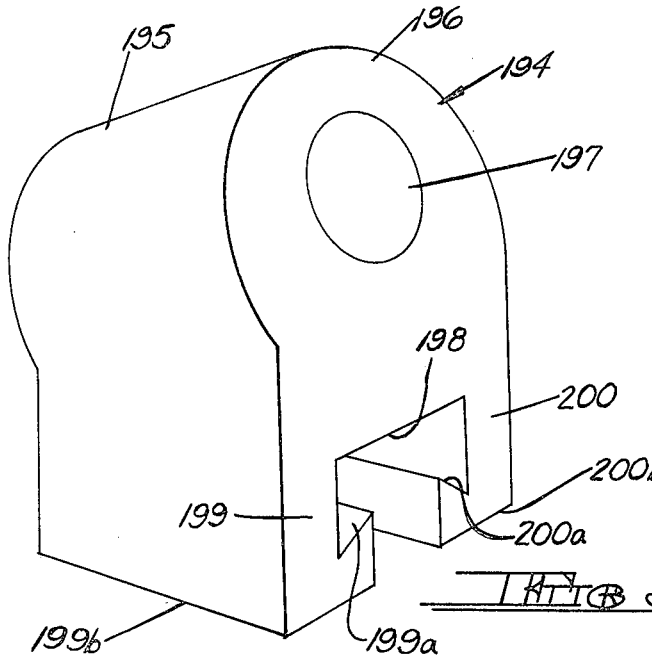
FIG. 30 is a perspective view of a modification of the lug of FIG. 27.
Figure 31:
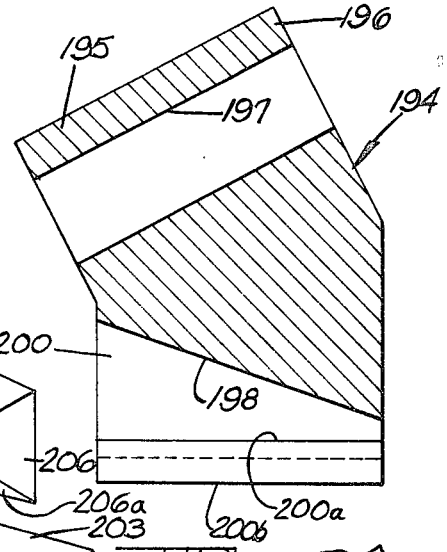
FIG. 31 is a longitudinal cross sectional view of the lug of FIG. 30.
Figure 32:
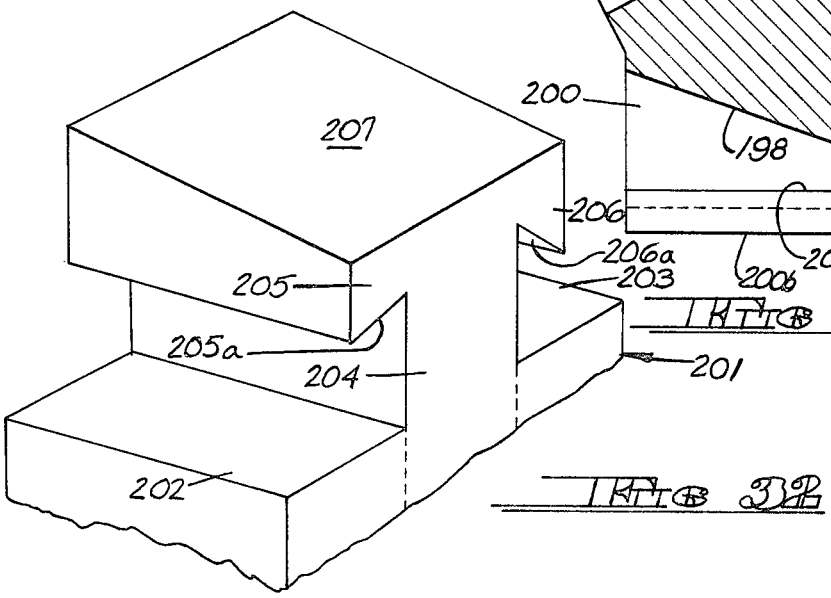
FIG. 32 illustrates a modification of the base member of FIG. 29 for accommodation of the lug of FIG. 30.
Figure 3B:
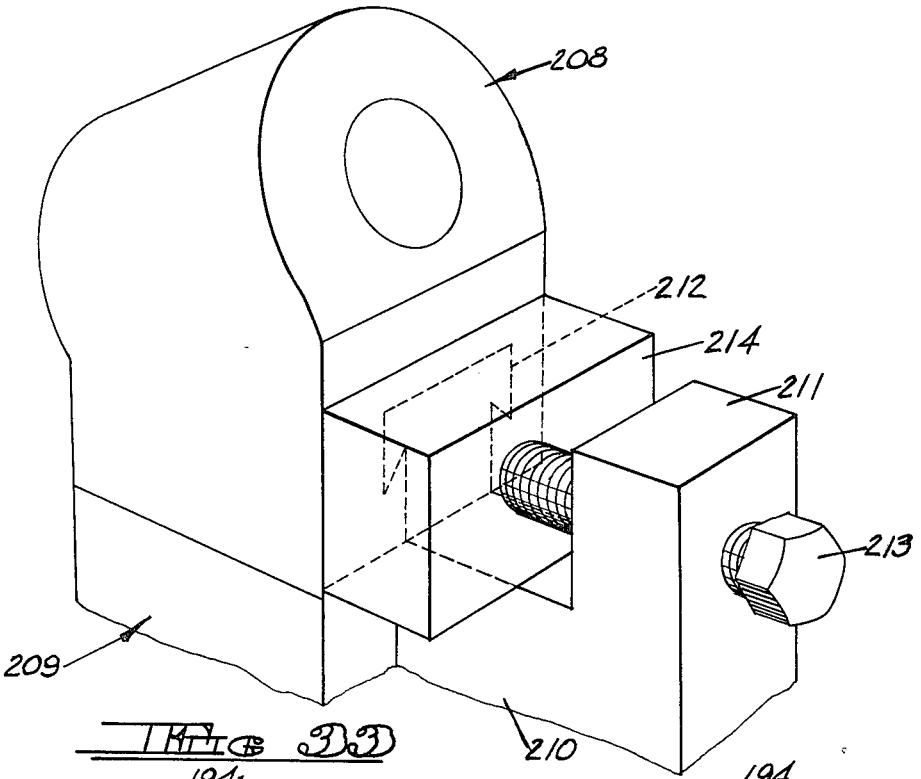
Figure 3A:
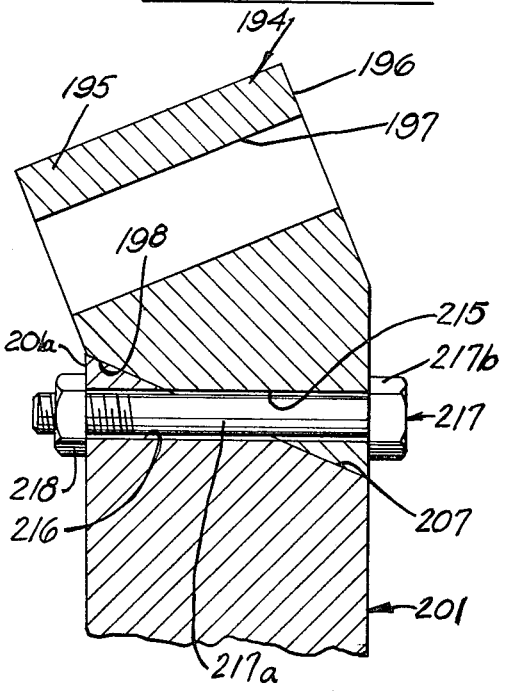
Figure 3D:
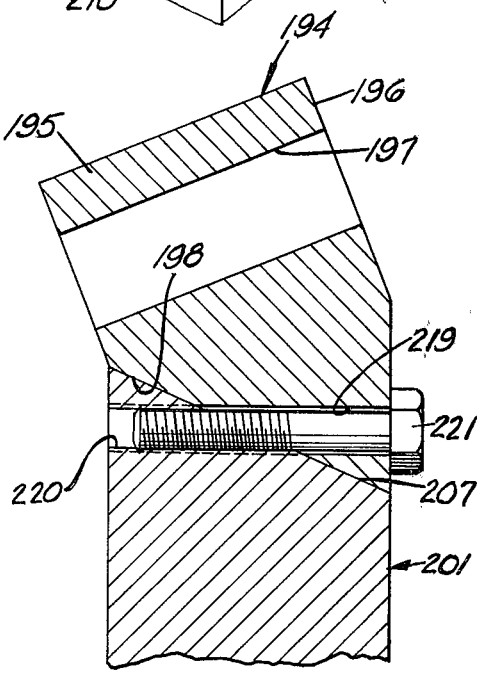

FIGS. 30 through 32 illustrate a modification of lug 178 of FIGS. 27 and 28, and of base member 185 of FIG. 29. The lug of FIGS. 30 and 31 is generally indicated at 194. The lug has an upper portion 195, a forward face 196 and a shank receiving perforation 197. Again, the lug is provided with a substantially planar bottom surface 198 flanked by a pair of downwardly depending legs 199 and 200. The legs have inturned flange surfaces 199*a* and 200*a*. The lug 194 of FIGS. 30 and 31 differs from the lug 178 of FIGS. 27 and 28 only in that its bottom surface 198 slopes upwardly and rearwardly while the inturned leg flanges 199*a* and 200*a* are dovetailed and of uniform vertical dimension throughout their length. Dovetailed extension 200*a* is clearly shown in FIG. 31. Dovetailed extension 199*a* is a mirror image thereof.

The base member of FIG. 32 is generally indicated at 201 and comprises a block-like structure having upper surfaces 202 and 203 which are substantially horizontal and coplanar. The upper surfaces 202 and 203 are separated by an upstanding portion 204 having parallel vertical sides. At its uppermost end, the portion 204 has lateral extensions 205 and 206, the bottom surfaces of which are undercut as at 205*a* and 206*a*. The base member 201 differs from base member 185 of FIG. 29 only in that the undercut undersides 205*a* and 206*a* of extensions 205 and 206 are of uniform vertical dimension while the upper surface 207 of the base member slopes upwardly and rearwardly.

Again it will evident from FIGS. 30 through 32 that the lug 194 may be engaged with the base member 201 by simply shifting the lug thereon in a direction from front to rear thereof. The inturned extensions 199*a* and 200*a* of lug legs 199 and 200 will have a wedging engagement with the base member extensions 205*a* and 206*a*. Again this will be a vertical wedging engagement between the last mentioned elements and the lug bottom surface 198 and base member top surface 207 which will be in abutment. There may also be a wedging action between the surfaces 202 and 203 on the one hand, and the lowermost surfaces 199*b* and 200*b* on the other hand, as occasioned by engagement of the inturned extensions 199*a*, 200*a* with the base member extensions 205*a*, 206*a*.

Reference is now made to FIG. 33 wherein a lug is generally indicated at 208 and a base member is generally indicated at 209. The lug 208 may be considered to be the same as either lug 178 of FIG. 27 or lug 194 of FIG. 30. Similarly, the rearward portion of base member 209, upon which lug 208 is mounted, may be considered to be the equivalent of base member 185 of FIG. 29 or base member 201 of FIG. 32. The base member 209 differs from the last mentioned base members only in that it has a forward extension 210 which is provided with an upstanding portion 211. The upstanding portion 211 is spaced from the upstanding portion 212 of the base member by a distance equivalent to the front to rear dimension of lug 208. In this way, lug 208 may be lowered between upstanding portions 211 and 212 and shifted rearwardly to accomplish a wedging engagement with base member 209.

The upstanding portion 211 of base member 209 is provided with a threaded perforation adapted to receive a retaining bolt 213. In order to assure that lug 208 does not become disengaged from base member 209 during a mining operation, a substantially rectangular block 214 may be located in front of the lug and in abutment against the lug forward surface and/or the forward surface of the base member upstanding portion 212. The rectangular block 214 is held in place by the engagement thereof by retaining bolt 213. To remove lug 208 from base member 209 for purposes of a replacement, it is only necessary to sufficiently withdraw bolt 213 and remove block 214. The lug 208 may then be shifted forwardly and lifted from base member 209.

FIG. 33 illustrates one way in which a retaining means of the type illustrated in FIG. 5 can be adapted for use with the lug and base member assembly of FIGS. 27 through 29 or the lug and base member assembly of FIGS. 30 through 32. Substantially any of the other retaining means taught herein can be applied to these assembles, as will be evident to one skilled in the art.

FIG. 34 illustrates the lug 194 of FIGS. 30 and 31 mounted on the base member 201 of FIG. 32. FIG. 34 also illustrates another form of retaining means. In this instance, lug 194 and base member 201 are provided with coaxial clearance holes 215 and 216, respectively. A retaining bolt 217 has a shank portion 217*a* which extends through perforations 215 and 216. The bolt 217 has a head 217*b* which abuts the forward face of lug 194. The bolt 217 is provided with a nut 218 at its other end which abuts the rear surface 201*a* of base member 201. In this way, the bolt 217 assures that lug 194 will not become disengaged from base member 201 during the mining operation.

FIG. 35 again illustrates lug 194 of FIGS. 30 and 31 mounted upon base member 201 of FIG. 32. In this instance, the lug 194 is provided with a clearance hole 219, while the base member 201 is provided with a coaxial threaded perforation 220. Again, a retaining bolt 221 is used. In this instance, the bolt extends through clearance hole 219 in lug 194 and is threadedly engaged in threaded perforation 220 of base member 201. As a consequence, retaining bolt 221 will again assure that lug 194 will remain on base member 202 during the mining operation.

Figure 36:
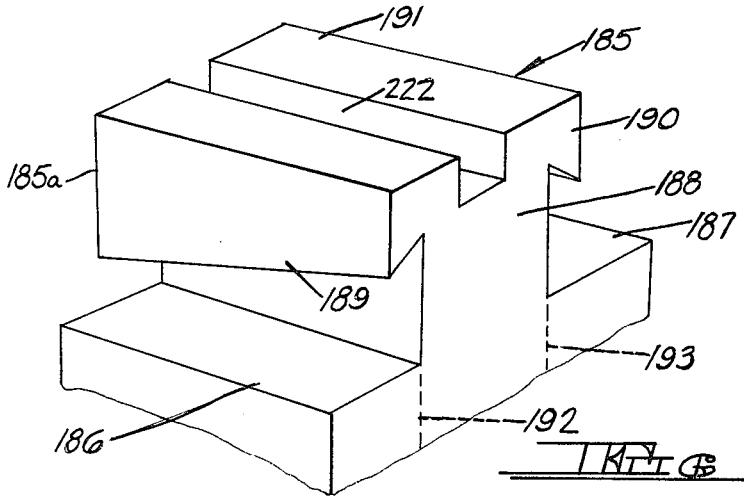
FIG. 36 is a fragmentary perspective view of a modification of the base member of FIG. 29.
Figure 37:
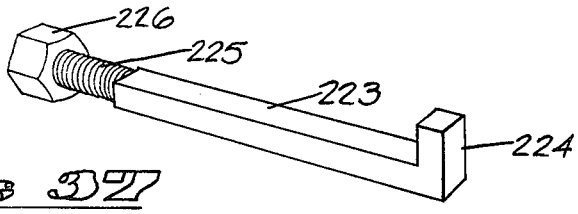
FIG. 37 is a perspective view of a retaining means for use with the base member of FIG. 36.
Figure 38:
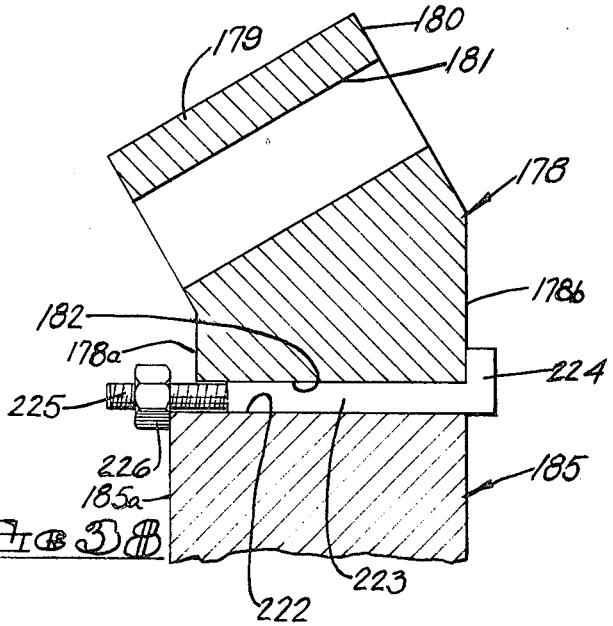
FIG. 38 is a fragmentary cross sectional elevational view illustrating the base member of FIG. 36 and the lug of FIGS. 27 and 28 provided with the retaining means of FIG. 37.

FIGS. 36 through 38 illustrate another type of retaining means which may be applied to the cutter-bit base member assembles of FIGS. 27 through 29 or FIGS. 30 through 32. For purposes of an exemplary showing, FIG. 36 illustrates the base member 185 of FIG. 29 and like parts have been given like index numerals. The base member 185 in FIG. 36 has been modified only in that the upper surface 191 of the base member has had a channel or groove 222 formed therein. The groove extends the length of upper surface 191.

FIG. 37 illustrates a retaining means for use with the base member 185 of FIG. 36. The retaining means comprises an elongated member 223 of rectangular cross section. At its forward end, the retaining means 223 has an upstanding portion 224 so that the retaining means is generally hooklike. At its rearward end, the retaining means 223 is threaded as at 225 and provided with a nut 226.

FIG. 38 illustrates lug 178 of FIG. 27 mounted on base member 185 of FIG. 36. When the lug 178 is so mounted, its bottom surface 182 cooperates with the channel 222 of base member 185 to convert the channel into a four sided perforation which extends from the forward surface to the rearward surface of the lug-base member assembly. Once the lug 178 has been mounted on base member 185, the hook-like retaining means 223 may be inserted in the channel 222. The nut 226 is then threaded onto the rear end of retaining means 223 and tightened. As will be evident from FIG. 38, the upstanding front portion 224 of retaining means 223 will abut and engage the forward surface **178*b* of lug 178. The nut 226 of the retaining means 223 will engage and abut one or the other, or both, of the rearward surfaces 178*a* and 185*a* of the lug 178 and base member 185. Thus, this assembly is securely held together until such time as the retaining means 223** is removed therefrom.

Figure 39:
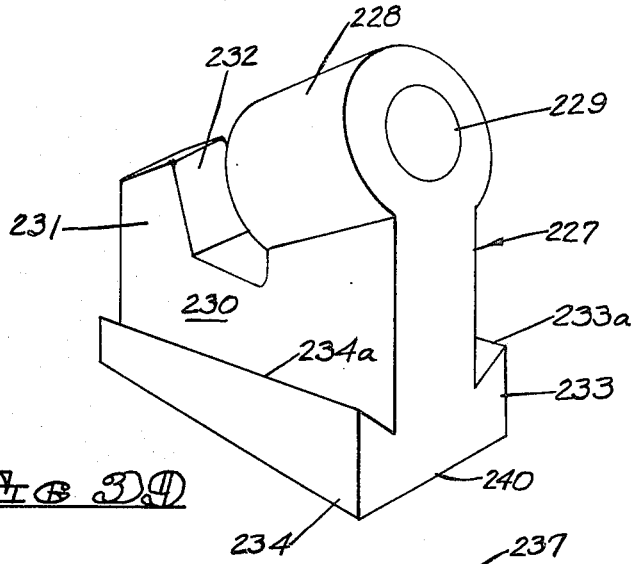
FIG. 39 is a perspective view of a lug constituting a modification of the lug of FIG. 1.
Figure 40:
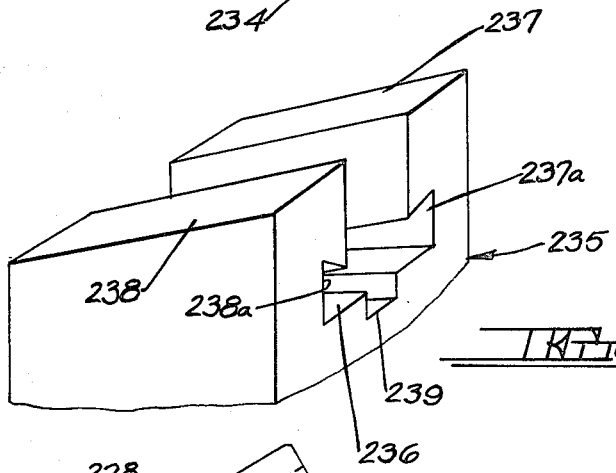
FIG. 40 is a fragmentary perspective view illustrating a base member for use with the lug of FIG. 39.
Figure 41:
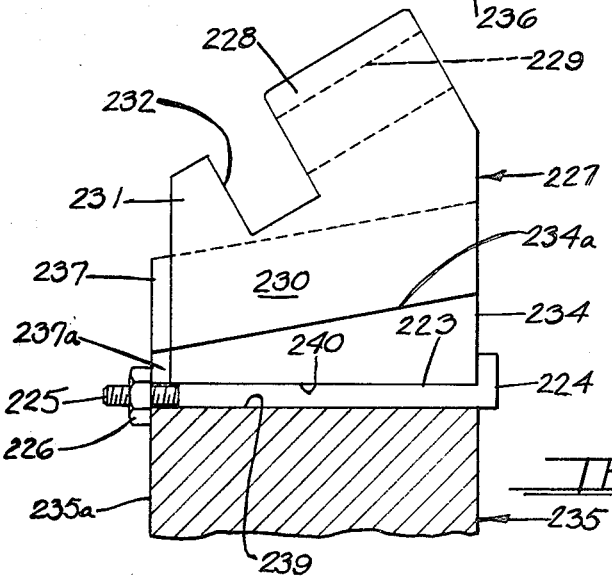
FIG. 41 is a fragmentary elevational view, partly in cross section, illustrating the lug of FIG. 39 mounted in the base of FIG. 40 and held in place by a retaining means of the type shown in FIG. 37.
Figure 4A:
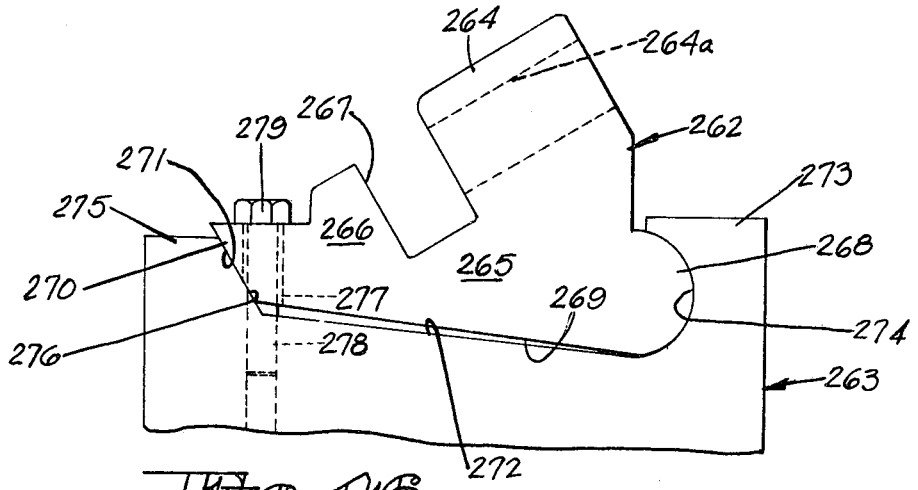
Figure 4A:
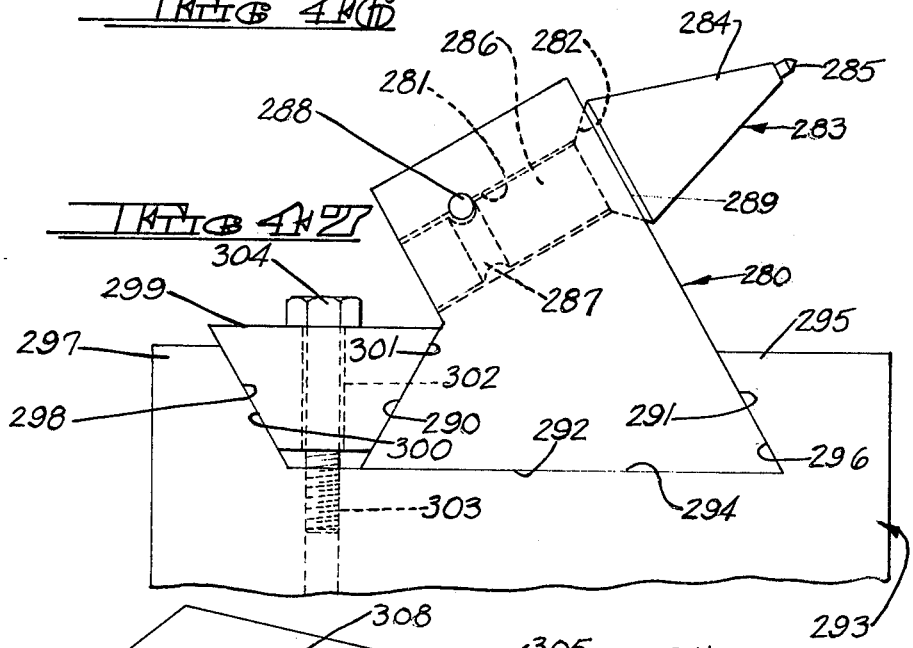
Figure 4A:
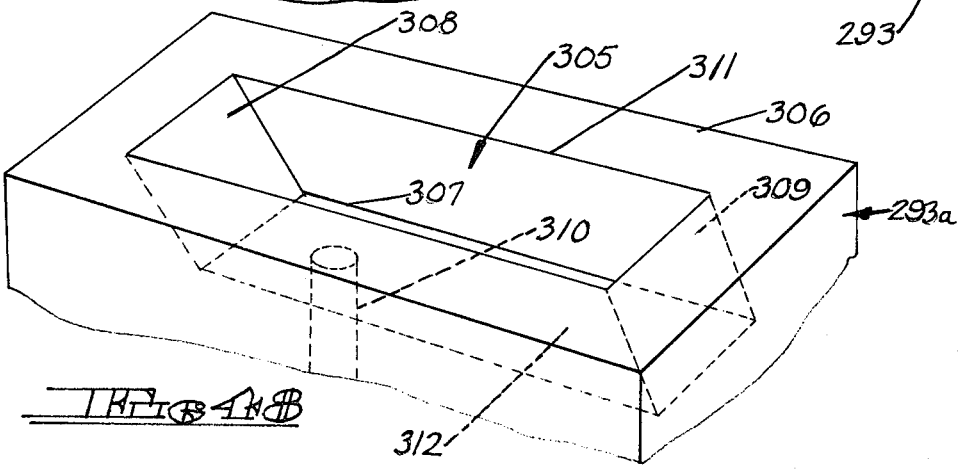

FIGS. 39 through 41 illustrate the fact that the retaining means 223 of FIG. 37 can be used with other embodiments of the present invention. To this end, a lug is generally indicated at 227 in FIG. 39. For purposes of an exemplary showing the lug is illustrated as being similar to the lug 1 of FIG. 1. Thus the lug has a body portion 228 having a shank receiving perforation 229 adapted to receive a cutter bit of the type shown at 2 in FIG. 4. Lug 227 has a rearward extension 230 terminating in an upstanding anvil portion 231 having an anvil surface 232.

The lug 227 is provided with lateral extensions 233 and 234, the upper surfaces **233*a* and 234*a* of which are dovetailed and slope slightly rearwardly and downwardly from the front of the lug to the rear thereof. The lateral extensions 233 and 234 are equivalent to extensions 15 and 16 of lug 1 of FIG. 1, differing therefrom only in that the extensions 233 and 234 traverse the full length of lug 227**.

A base member for lug 227 is generally indicated at 235 in FIG. 40. The base member comprises a block-like structure having an upper substantially planar surface 236 flanked by a pair of bifurcations 237 and 238. The bifurcations 237 and 238 are the full equivalent of bifurcations 20 and 21 of base member 18 of FIG. 2. Thus, the bifurcations 237 and 238 have formed in their facing surfaces a pair of longitudinally extending, undercut slots **237*a* and 238*a*. The undercut slots 237*a* and 238*a* are adapted to cooperate with the dovetailed lateral extensions 233 and 234 of lug 227 in the same way that the undercut slots 20*a* and 21*a* of base member 18 (FIG. 2) cooperate with the lateral extensions 15 and 16 of lug 1 of FIG. 1** to produce a vertical wedging action.

The upper surface 236 of base member 235 has a longitudinally extending groove or channel 239 formed therein. The channel 239 extends the length of base member 235 and is so dimensioned as to receive a retaining means of the type shown at 223 in FIG. 37.

FIG. 41 illustrates the lug 227 of FIG. 39 mounted in base member 235 of FIG. 40. Like parts have been given like index numerals. The assembly has mounted therein a retaining means identical to that of FIG. 37. As a consequence, the retaining means of FIG. 41 has been given the same index numerals as are used in FIG. 37.

Once the lug 227 is inserted in base member 235, it will be understood that the bottom surface 240 of the lug will enclose the channel 239. The hooklike retaining means 223 is inserted through the enclosed channel and the nut 226 is tightened on the rearward end of the retaining means. When the nut 226 is sufficiently tightened, the upstanding front end 224 of the retaining means will engage the front surface of lug 227. At the same time, the nut 226 will engage the rear surface **235*a* of base member 235, assuring that these elements are securely held together until such time as retaining means 223** is removed therefrom.

Another embodiment of the present invention is illustrated in FIGS. 42 through 45. In this embodiment, a lug is generally indicated at 241. The lug is similar to lug 1 of FIG. 1 and has a body portion 242 with a shank receiving perforation 243 extending therethrough. The lug has an extended portion 244 terminating in an upstanding anvil portion 245 presenting an anvil surface 246. The lug 241 is adapted to receive a cutting bit of the type illustrated at 2 in FIG. 4. Since the cutter bit is identical to that of FIG. 4, like parts have been given like index numerals.

The lug 241 has a pair of lateral extensions 247 and 248, the upper edges **247*a* and 248*a* of which are dovetailed and slope rearwardly and downwardly throughout the length of the lug. The lug has a bottom surface 249 which slopes upwardly and rearwardly, as shown in FIG. 42**.

A base member is generally indicated at 250. The base member has an upper surface which corresponds to the bottom surface 249 of lug 241 and thus slopes upwardly and rearwardly. The upper surface 251 of the base member is flanked by a pair of bifurcations 252 and 253 in parallel spaced relationship. The upper ends of these bifurcations are provided with facing, inwardly extending undercut lugs **252*a* and 253*a*. As will be evident from FIG. 43, the undercut lugs 252*a* and 253*a* engage and cooperate with the dovetailed upper surfaces of extensions 247*a* and 248*a* and this cooperation, together with the abutment of the lug bottom surface 249 and base member upper surface 251 forms a vertical wedging engagement between the lug 241 and base member 250**.

The bifurcations 252 and 253 are provided with a pair of elongated, coaxial openings 254 and 255. The lug 241 is provided with a transverse elongated perforation 256. As will be evident from the cross sectional view of FIG. 45, when the lug 241 is fully seated in base member 250, the transverse perforation 256 of lug 241 lies slightly ahead of or forwardly of the coaxial openings 254 and 255 of the base member 250.

In FIG. 44 there is illustrated a retaining means generally indicated at 257. The retaining means is made up of a rearward metallic element 258, an intermediate resilient element 259 and a forward metallic element 260. The elements 258, 259 and 260 are permanently adhered together. The forward element 260 has located, centrally thereof, a forwardly extending nose 261 which is an integral one-piece part of the portion 260. The provision of resilient portion 259 enables the metallic portions 258 and 260 to be compressed toward each other.

Once the lug 241 has been fully seated in base member 250, the retaining means 257 may be inserted in the base member openings 254 and 255 and the lug perforation 256. To do this, it is only necessary to compress the retaining means 257 and start it either through base member opening 254 or base member opening 255. As is evident from FIG. 45, the nose portion 261 is slightly beveled at its ends to assist in compressing the retaining means 257 during insertion thereof. Once the retaining means 257 is located in place, as shown in FIG. 45, the retaining means nose portion 261 will extend forwardly of the base member openings 254 and 255, preventing inadvertent removal of the retaining means. When in position in the base member and lug, the retaining means 257 will remain slightly compressed. As is evident from FIG. 45 the forward portion 260*a* of the retaining means contacts the forward ends of base member openings 254 and 255. The rearward member 258 of the retaining means 257 abuts the rearward end of lug perforation 256. Thus, the retaining means will constantly urge the lug toward its wedging engagement with base member 250. This wedging engagement between lug 241 and base member 250 will assure that the retaining means 257 is free of resultant cutting forces.

Reference is now made to FIG. 46 wherein another embodiment of the present invention is illustrated. This embodiment comprises a lug generally indicated at 262 and a base member indicated at 263. Again for purposes of illustration, the lug 262 is shown as being of the type adapted to accommodate a bit of the type illustrated at 2 in FIG. 4. The lug comprises a body portion 264 having a shank receiving perforation 264*a* passing therethrough. The lug has an extension 265 terminating in an upstanding anvil portion 266 providing an anvil surface 267. At its forwardmost end, the lug is provided with a projection 268 the periphery of which constitutes a segment of a circle. The lug 262 has a bottom surface 269 which slopes slightly upwardly and rearwardly. The anvil portion 266 extends rearwardly as at 270 presenting a rear surface 271 which slopes downwardly and forwardly.

The base member 263 has an upper surface 272 which slopes slightly upwardly and rearwardly and is intended to cooperate with the bottom surface 269 of lug 262. At its forward end, the base member 263 has an upward extension 273. The extension 273 has a rearward surface 274 which is curved at the same radius as the periphery of the lug projection 268. At its rearward end, the base member 263 has a second upward projection 275, provided with a surface 276 which slopes forwardly and downwardly and is intended to cooperate with the surface 271 of the extended portion 270 of lug anvil 266.

The extended portion 270 has a substantially vertical perforation 277 therein. The base member 263 has a substantially coaxial threaded perforation 278 extending downwardly therethrough. The embodiment of FIG. 46 utilizes a threaded bolt 279 as a retaining means. When the lug 262 is mounted in base member 263, the forward projection 268 of the lug is caused to engage the surface 274 of the forward extension 273 of the base member. The lug is then pivoted in a counterclockwise direction (as viewed in FIG. 46) until its rearwardmost surface 271 engages the surface 276 of the base member. At this point, the retaining means bolt 279 is inserted through the perforation 277 of the lug (passing therethrough with clearance) and is threadedly engaged in the perforation 278 of the base member. As a result, the bolt 279 maintains the lug 262 in base member 263 with a longitudinal wedging action, occuring between the peripheral surface of forward projection 268 and the adjacent base member surface 274 and to cooperating lug surface 271 and base member surface 276. Since the retaining means bolt 279 passes through perforation 277 with clearance, the bolt will be free of the resultant cutting forces which will tend to further seat lug 262 in base member 263. Upon removal of retaining means bolt 279, the lug can be pivoted in a clockwise direction (as viewed in FIG. 46) and removed from base member 263.

Yet another embodiment of the present invention is illustrated in FIG. 47. For purposes of illustration, a lug generally indicated at 280 is illustrated as being of a type adapted to accommodate a plumb bob bit. To this end, the lug 280 has a shank receiving perforation 281 terminating at the forward end of the lug in a flared shoulder 282. The lug 280 is illustrated as carrying plumb bob bit 283 having a head portion 284 terminating in a hard cutting tip 285. The bit 283 also has a shank portion 286. The shank has an annular notch 287 formed therein to accommodate a retaining pin 288 similar to that described in FIG. 16 at 107. Between the cutter bit head portion 284 and shank portion 286 there is a conical portion 289 adapted to abut the flared lug surface 282 and serve as a gauge-determining abutment for the rotatable plumb bob bit. The lug 280 has a rear surface 290 which slopes rearwardly and downwardly and a front surface 291 which slopes rearwardly and forwardly. The surfaces 290 and 291 terminate in a flat bottom surface 292.

A base member is generally indicated at 293. The base member has an upper surface 294 which is planar and substantially horizontal. At its forward end, the base member 293 has an upward extension 295, the rear surface 296 of which slopes forwardly and downwardly at substantially the same angle as the front surface 291 of lug 280. The base member also has an upward extension 297 at its rearward end. The upward extension 297 has a front surface 298 which slopes forwardly and downwardly.

The retaining means of the embodiment of FIG. 47 comprises a wedge element 299 having a rear surface 300 corresponding to the forward surface 298 of the base member rear extension 297 and a forward surface 301 corresponding to the rear surface 290 of lug 280. The wedge 299 has a clearance hole 302 therethrough. The base member 293 has a threaded perforation 303 extending downwardly therethrough, the threaded perforation 303 normally being coaxial with clearance hole 302. The structure is also provided with a bolt 304.

The operation of the structure of FIG. 47 may be described as follows. The lug 280 is first placed in the position shown in base member 293. Thereafter, the wedge 299 is located behind the lug and is held in place by bolt 304. To remove the lug, it is only necessary to remove bolt 304 and wedge 299, whereupon the lug can be lifted from base member 293. This embodiment is another example of a longitudinal wedging engagement. The lug is wedged between the surface 296 of the forward extension 295 of the base member and the surface 301 of wedge 299. The rear surface 300 of wedge 299, in turn, cooperates with the forward surface 298 of the base member rear extension 297. It will be understood by one skilled in the art that if the angularity of the front surface 291 of lug 280 is the same as its rear surface 290, and if the angularities of base member surface 296 and wedge surface 301 are complimentary, the lug 280 is reversible in base member 293. Unlike all of the previously described embodiments, the retaining means of the structure of FIG. 47 (i.e. wedge 299 and bolt 304) are subject to at least some of the resultant cutting forces.

The base member 293 of FIG. 47 can be provided with sides so as to preclude any lateral shifting of lug 280. Such a modification of base member 293 is illustrated in FIG. 48. There a base member 293*a* is shown. The base member 293 comprises a block-like structure having a recess generally indicated at 305 formed in its upper surface 306. The recess has a bottom surface 307 corresponding to the upper surface 294 of base member 293. The recess also has a rear surface 308 and a front surface 309 corresponding to surfaces 298 and 296, respectively of the base member 293 of FIG. 47. The bottom surface 307 of base member 293 has a threaded perforation 310 extending therein. The threaded perforation 310 is equivalent to threaded perforation 303 of FIG. 47. It will be understood that the operation of base member 293*a* is identical to that of base member 293, differing only in that the recess 305 results in the provision of longitudinal sides 311 and 312 which would preclude any lateral movement of either base member 280 or wedge 299 (FIG. 47).

Figure 49:
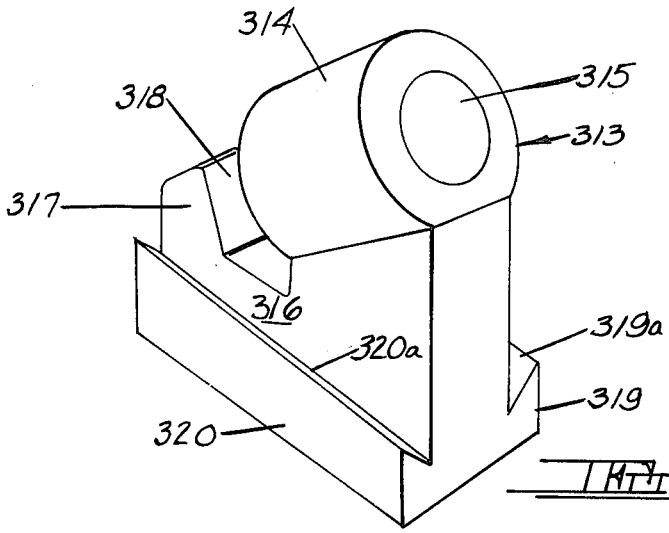
FIG. 49 is a perspective view of a lug constituting another modification of the lug of FIG. 1.

A final embodiment of the lug-base member-retaining means assembly of the present invention is illustrated in FIGS. 49 through 52. Turning first to FIG. 49 a lug is generally indicated at 313. Again, for purposes of an exemplary showing the lug is illustrated as being of the type adapted to receive a rotatable pick-type cutter bit of the general character indicated at 2 in FIG. 4. The lug 313 has a main body portion 314 provided with a shank receiving perforation 315. The lug has a rearward extension 316 terminating in an upstanding anvil portion 317 providing an anvil surface 318. The lug is also provided with lateral extensions 319 and 320, the upper surfaces 319*a* and 320*a* of which are dovetailed. The lug 313 of FIG. 49 differs from the lug 227 of FIG. 38 only in that the upper dovetailed surfaces 319*a* and 320*a* slope rearwardly and upwardly, rather than rearwardly and downwardly.

Figure 50:
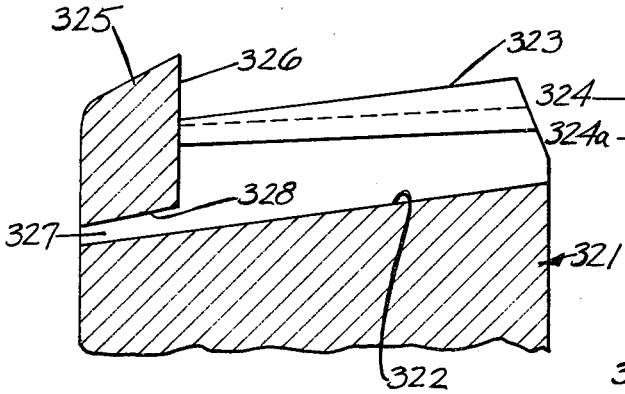
FIG. 50 is a fragmentary cross sectional view of a base member for use with the lug of FIG. 49.
Figure 51:
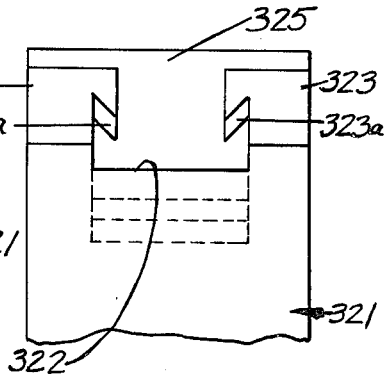
FIG. 51 is a fragmentary front elevational view of the lug of FIG. 50.

A base member for use with the lug 313 is generally indicated at 321 in FIGS. 50 and 51. The base member is a block-like structure having an upper surface 322 which slopes rearwardly and downwardly. The upper surface 322 is flanked by a pair of bifurcations 323 and 324 which are undercut as at 323*a* and 324*a*, which undercuts correspond to the dovetailed upper surfaces 319*a* and 320*a* of lug 313.

At the rearward end of base member 321 the bifurcations 323 and 324 are joined by a transverse wall 325. The transverse wall 325 provides a forward abutment surface 326. The base member 321 is completed by the provision of a slot 327 beneath rear wall 325. The bottom of slot 327 constitutes a continuation of base member upper surface 322. The top of the slot, defined by the bottom surface 328 of the rear wall 325 slopes rearwardly and downwardly at a slightly greater angle than base member upper surface 322 so that the slot 327 is wedge-shaped.

Figure 52:
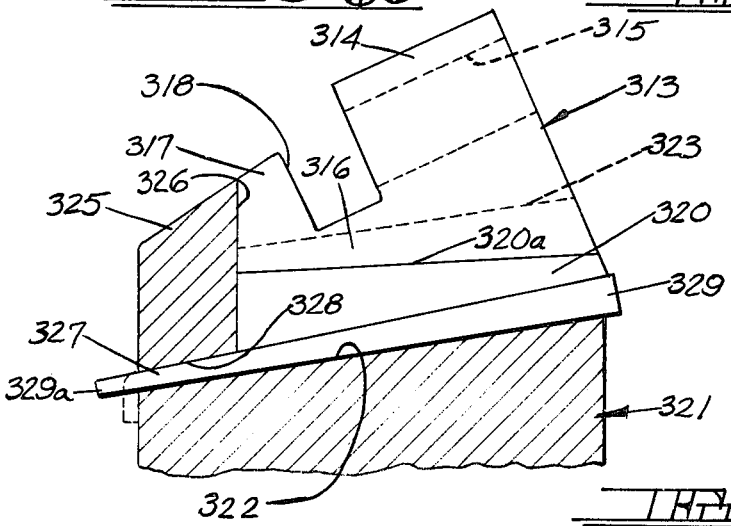
FIG. 52 is a fragmentary elevational view, partly in cross section, illustrating the lug of FIG. 49 mounted in the base member of FIG. 50 and provided with a retaining means.

In use, the lug 213 is inserted between bifurcations 323 and 324 and shifted rearwardly until the rear end of lug 313 abuts the surface 326 of the base member rear wall 325. The lug 313 is then lifted upwardly until the upper surfaces 319*a* and 320*a* of lug extensions 319 and 320 contact the undercut surfaces 323*a* and 324*a* of bifurcations 323 and 324. Thereafter, a retaining means in the form of an elongated, tapered wedge 329 is inserted beneath the lug 313 and shifted rearwardly until the lug 313 is wedged tightly in base member 321. When the retaining wedge 329 is fully seated, its rearwardmost end 329*a* will extend beyond base member slot 327. Various means may be affixed to the rearward end 329*a* of wedge 329 to maintain the wedge in its full seated position; alternatively, the rearward end 329*a* of the wedge 329 may simply be pounded over, as is indicated in FIG. 52 in broken lines. It will be understood that the retaining means 329 (like the retaining means of FIG. 47, but unlike all of the remaining retaining means hitherto described), will be subjected to the resultant cutting forces.

Modifications may be made in the invention without departing from the spirit of it.

What we claim is:

1. In a mining machine or the like of the type having at least one driven element adapted to advance a lug-base member assembly in a cutting direction, a base member mounted on said driven element, a bit carrying lug removably mounted in said base member, and a separate cutter bit removably mounted in said lug with a cutting end of said cutter bit exposed to act upon the material being cut, the improvement which comprises: said lug and said base member being configured so as to have a wedging engagement therebetween, which wedging engagement is enhanced when the said lug-base member assembly is moved in said cutting direction and said cutter bit acts upon the material being cut; said wedging engagement being achieved by at least one set of interrupted cooperating wedging surfaces on said lug and base member for retaining said lug within said base member while providing lateral support for said lug; and a separate retaining means for maintaining said lug in said base member, said retaining means being located so as to prevent said lug from being removed from said base member accidentally, and said retaining means being so configured and positioned as to enable said retaining means to be installed after said lug has been mounted in said base member.

2. The lug-base member assembly of claim 1 in which said retaining means comprises a retainer member mounted on said base member and adjacent said lug.

3. The assembly of claim 2 in which said retainer member is pivotally connected to said base member and movable to a position adjacent said lug after said lug is wedged on its said base member.

4. The assembly of claim 3 in which said retainer member is spring-biased so as to be engageable with said lug.

5. The assembly of claim 2 in which said retainer member comprises a bolt.

6. The assembly of claim 5 in which said base member is provided with an upstanding wall spaced so as to permit said lug to be placed on said base member prior to effecting said wedging engagement, said bolt passing horizontally through said wall to engage said lug.

7. The assembly of claim 5 including a block held on said base member adjacent said lug by said bolt.

8. The assembly of claim 7 including an upstanding wall on said base member spaced so as to permit said lug to be placed on said base member prior to effecting said wedging engagement, said block being positioned between said wall and said lug.

9. The assembly of claim 8 in which said bolt passes through said block into said base member.

10. The assembly of claim 8 in which said bolt passes horizontally through said wall and into said block.

11. The assembly of claim 10 in which said block has a wedging engagement with said wall.

12. The assembly of claim 2 in which said base member is provided with an upstanding wall spaced so as to permit said lug to be placed on said base member prior to effecting said wedging engagement, said wall having an undercut portion facing towards said lug when said lug is received in said base member, and said retainer member comprising a wedge-like block comprised in part at least of a resilient material, said wedge-like block having a protruding surface to frictionally engage said undercut portion of said wall when said wedge-like block is forced onto said base member after the wedging engagement of said lug in said base member has been effected.

13. The assembly of claim 2 in which said retainer member comprises a rod-like element extending adjacent that side of said lug which faces in the said cutting direction after said wedging engagement has been effected.

14. The assembly of claim 1 in which said base member is provided with a slot therein extending throughout the length of said base member in said cutting direction, said slot being so located as to be covered by said lug when in said wedging engagement with said base member, and said retaining means comprising an L-shaped member located in said slot, said L-shaped member having a first means engaging said lug towards the cutting direction and having a second means which engages said base member away from the cutting direction.

15. The assembly of claim 1 in which said lug and said base member are provided with transverse openings which are partially alligned when said wedging engagement is achieved, a said opening in said lug being off-set in the said cutting direction from a said opening in said base member, and said retaining means comprises an elongated member which is in part at least resilient so as to be compressable into said partially alligned openings, said elongated member having a nose portion extending in the cutting direction beyond a said opening in said base member into a said opening in said lug and into engagement with said lug, said elongated member being free of said base member at the side of a said base member opening away from said cutting direction.

16. The assembly of claim 1 in which said wedging engagement is effective vertically, one of said lug and said base member being provided with a dovetailed extension having a surface slanted both horizontally and vertically and the other of said lug and said base member being provided with an undercut slot to receive said dovetailed extension in wedging engagement therewith.

17. The assembly of claim 1 in which said wedging engagement is effective laterally, one of said lug and said base member being provided with a tapered lateral extension, and the other of said lug and said base member having a tapered undercut slot to receive said lateral extension in wedging engagement therewith.

18. The assembly of claim 1 in which said wedging engagement is effective universally, one of said lug and said base member being provided with a tapered conical surface and the other of said lug and said base member being provided with a tapered conical cavity to receive said conical surface in wedging engagement therewith.

19. The structure claimed in claim 1 wherein said retaining means for maintaining said lug in said base member is so positioned as to be free of resultant cutting forces sustained by said lug-base member assembly when such assembly is moved in said cutting direction.

20. The structure claimed in claim 1 wherein said retaining means is located exteriorly of said lug.

21. The structure claimed in claim 1 wherein said retaining means engages at least one of said lug and said base member but is free of transverse engagement with both the wedged together lug and base member.

22. The assembly of claim 21 in which said lug is provided with an extension protruding beyond said base member in a direction opposite from said cutting direction, and said retaining means comprises a rod-like element located in the protruding portion of said extension away from said base member.

23. In a mining machine or the like of the type having at least one driven element adapted to advance a lug-base member assembly in a cutting direction, a base member mounted on said driven element, a bit carrying lug removably mounted in said base member, and a cutter bit mounted in said lug with a cutting end of said cutter bit exposed to act upon the material being cut, the improvement which comprises: said lug and said base member being configured so as to have a wedging engagement therebetween, which wedging engagement is enhanced when the said lug-base member assembly is moved in said cutting direction and said cutter bit acts upon the material being cut; and separate retaining means for maintaining said lug in said base member, said retaining means being located so as to prevent said lug from being removed from said base member acidentally, and said retaining means being so configured and positioned as to enable said retaining means to be installed after said lug has been mounted in said base member, said retaining means being mounted on said base member adjacent said lug and further comprising a bolt and including a block held on said base member by said bolt; said base member having an upstanding wall thereon spaced so as to permit said lug to be placed on said base member prior to effecting said wedging engagement, said block being positioned between said wall and said lug, said wall having a slot therein, said bolt passing horizontally through said slot and into said block, and said block having a wedging engagement with said wall.

24. In a mining machine or the like of the type having at least one driven element adapted to advance a lug-base member assembly in a cutting direction, a base member mounted on said driven element, a bit carrying lug removably mounted in said base member, and a cutter bit mounted in said lug with a cutting end of said cutter bit exposed to act upon the material being cut, the improvement which comprises: said lug and said base member being configured so as to have a wedging engagement therebetween, which wedging engagement is enhanced when the said lug-base member assembly is moved in said cutting direction and said cutter bit acts upon the material being cut; and separate retaining means for maintaining said lug in said base member, said retaining means being located so as to prevent said lug from being removed from said base member accidentally, and said retaining means being so configured and positioned as to enable said retaining means to be installed after said lug has been mounted in said base member, said retaining means being mounted on said base member adjacent said lug and further comprising a bolt and including a block held on said base member by said bolt; said base member having an upstanding wall thereon spaced so as to permit said lug to be placed on said base member prior to effecting said wedging engagement, said block being positioned between said wall and said lug; and said bolt passing through said wall and abutting said block so as to frictionally hold it on said base member.

25. In a mining machine or the like of the type having at least one driven element adapted to advance a lug-base member assembly in a cutting direction, a base member mounted on said driven element, a bit carrying lug removably mounted in said base member, and a cutter bit mounted in said lug with a cutting end of said cutter bit exposed to act upon the material being cut, the improvement which comprises: said lug and said base member being configured so as to have a wedging engagement therebetween, which wedging engagement is enhanced when the said lug-base member assembly is moved in said cutting direction and said cutter bit acts upon the material being cut; and separate retaining means for maintaining said lug in said base member, said retaining means being located so as to prevent said lug from being removed from said base member accidentally, and said retaining means being so configured and positioned as to enable said retaining means to be installed after said lug has been mounted in said base member, said retaining means being mounted on said base member adjacent said lug and further comprising a bolt having a shank of a given diameter, said lug being provided with a perforation of a diameter greater than said given diameter so as to receive said bolt in such manner that said shank is out of contact with said lug, said base member also being provided with a perforation to receive said shank, said lug perforation and said base member perforation being aligned, said shank having a head on one end to engage said lug, and means on the other end of said shank to engage said base member.

26. The assembly of clam 25 in which said last mentioned means comprises a nut.

27. The assembly of claim 25 in which said last mentioned means comprises a threaded engagement of said shank with said base member.

28. In a mining machine or the like of the type having at least one driven element adapted to advance a lug-base member assembly in a cutting direction, a base member mounted on said driven element, a bit carrying lug removably mounted in said base member, and a cutter bit mounted in said lug with a cutting end of said cutter bit exposed to act upon the material being cut, the improvement which comprises: said lug and said base member being configured so as to have a wedging engagement therebetween, which wedging engagement is enhanced when the said lug-base member assembly is moved in said cutting direction and said cutter bit acts upon the material being cut; and separate retaining means for maintaining said lug in said base member, said retaining means being located so as to prevent said lug from being removed from said base member accidentally, and said retaining means being so configured and positioned as to enable said retaining means to be installed after said lug has been mounted in said base member, said retaining means being mounted on said base member adjacent said lug and further comprising a bolt and including a block held on said base member by said bolt; said base member being provided with an upstanding extension spaced so as to permit said wedging engagement to be effected prior to placement of said retaining means, said extension and said lug having surfaces which slope towards one another, and said block having the cross section of an inverted truncated cone with wedging surfaces to engage said first mentioned surfaces, said block having a clearance hole through which said bolt passes, said base member being provided with a threaded hole to receive and engage said bolt, and said bolt having a head to abut said block.

29. The assembly of claim 28 in which said base member has an undercut portion in the direction of said cutting direction and spaced from said upstanding extension, and said lug has a forward projection to be received in said undercut portion.

30. In a mining machine or the like of the type having at least one driven element adapted to advance a lug-base member assembly in a cutting direction, a base member mounted on said driven element, a bit carrying lug removably mounted in said base member, and a cutter bit mounted in said lug with a cutting end of said cutter bit exposed to act upon the material being cut, the improvement which comprises: said lug and said base member being configured so as to have a wedging engagement therebetween, which wedging engagement is enhanced when the said lug-base member assembly is moved in said cutting direction and said cutter bit acts upon the material being cut; and a separate retaining means for maintaining said lug in said base member, said retaining means being located so as to prevent said lug from being removed from said base member accidentally, and said retaining means being so configured and positioned as to enable said retaining means to be installed after said lug has been mounted in said base member; said base member being provided with a wall at the end thereof which is away from said cutting direction, said lug abutting said wall when said engagement is effected, said lug being tiltable with respect to said base member, and said wall having a tapered slot therein, the bottom of said slot coinciding with the top of that part of said base member from which said wall extends upwardly; and said retaining means comprises a tapered wedge located between the bottom of said lug and the said top of said base member and extending through and beyond said tapered slot in frictional engagement with said wall, and said tapered wedge having means beyond said wall to maintain it in said frictional engagement with said wall.

31. The assembly of claim 30 in which one of said lug and said base member has a dovetailed extension and the other of said lug and said base member has an undercut slot to receive said dovetailed extension.

32. In a mining machine or the like of the type having at least one driven element adapted to advance a lug-base member assembly in a cutting direction, a base member mounted on said driven element, a bit carrying lug removably mounted in said base member, and a cutter bit mounted in said lug with a cutting end of said cutter bit exposed to act upon the material being cut, the improvement which comprises: said lug and said base member being configured so as to have a wedging engagement therebetween, which wedging engagement is enhanced when the said lug-base member assembly is moved in said cutting direction and said cutter bit acts upon the material being cut; and a separate retaining means for maintaining said lug in said base member, said retaining means being located so as to prevent said lug from being removed from said base member accidentally, and said retaining means being so configured and positioned as to enable said retaining means to be installed after said lug has been mounted in said base member; said base member having an upstanding wall at the end thereof away from said cutting direction, said wall being undercut towards said cutting direction, said lug having an extension to engage within the undercut portion of said wall, said base member having a lateral extension and said lug having an arm with a flange to receive said lateral extension, and said retaining means acting to force said extension of said lug into engagement within the undercut portion of said wall while said lateral extension is received within said flange.

33. In a mining machine or the like of the type having at least one driven element adapted to advance a lug-base member assembly in a cutting direction, a base member mounted on said driven element, a bit carrying lug removably mounted in said base member, and a cutter bit mounted in said lug with a cutting end of said cutter bit exposed to act upon the material being cut, the improvement which comprises: said lug and said base member being configured so as to have a wedging engagement therebetween, which wedging engagement is enhanced when the said lug-base member assembly is moved in said cutting direction and said cutter bit acts upon the material being cut; and a separate retaining means for maintaining said lug in said base member, said retaining means being located so as to prevent said lug from being removed from said base member accidentally, and said retaining means being so configured and positioned as to enable said retaining means to be installed after said lug has been mounted in said base member; said lug being provided with a first extension in the direction of said cutting direction and terminating in a projection the periphery of which constitutes a segment of a circle and a second extension spaced from said first extension, said base member having a first wall provided with a socket-like surface to receive said projection and a second wall to be abutted by said second extension, said retaining means comprising a bolt, and said second extension having a clearance hole through which said bolt freely passes and said base member having a threaded hole to receive and engage said bolt.

* * * * *